US009415885B2

(12) United States Patent
Py

(10) Patent No.: US 9,415,885 B2
(45) Date of Patent: Aug. 16, 2016

(54) DEVICE WITH SLIDING STOPPER AND RELATED METHOD

(71) Applicant: Dr. Py Institute, LLC, New Milford, CT (US)

(72) Inventor: Daniel Py, Larchmont, NY (US)

(73) Assignee: Dr. Py Institute LLC, New Milford, CT (US)

( * ) Notice: Subject to any disclaimer, the term of this patent is extended or adjusted under 35 U.S.C. 154(b) by 247 days.

(21) Appl. No.: 14/208,030

(22) Filed: Mar. 13, 2014

(65) Prior Publication Data

US 2014/0263147 A1 Sep. 18, 2014

Related U.S. Application Data

(60) Provisional application No. 61/799,423, filed on Mar. 15, 2013.

(51) Int. Cl.

| | |
|---|---|
| ***B67C 3/26*** | (2006.01) |
| ***B65B 3/00*** | (2006.01) |
| ***B65D 8/00*** | (2006.01) |

(Continued)

(52) U.S. Cl.

CPC ..... *B65B 3/003* (2013.01); *A61J 1/2051* (2015.05); *B65D 11/04* (2013.01); *B65D 71/502* (2013.01); *A61J 1/2096* (2013.01)

(58) Field of Classification Search

CPC ..... B65D 3/003
USPC ..... 141/18, 251, 284, 329
See application file for complete search history.

(56) References Cited

U.S. PATENT DOCUMENTS

| | | | |
|---|---|---|---|
| 3,809,082 | A | 5/1974 | Hurschman |
| 4,135,561 | A | 1/1979 | Senelonge |
| 4,869,720 | A | 9/1989 | Chernack |

(Continued)

FOREIGN PATENT DOCUMENTS

| | | | |
|---|---|---|---|
| WO | WO 88/00707 | A1 | 1/1988 |
| WO | WO2004/071878 | A2 | 8/2004 |

(Continued)

OTHER PUBLICATIONS

International Search Report and Written Opinion from corresponding PCT International Application No. PCT/US2014/028497 dated Aug. 8, 2014.

*Primary Examiner* — Jason K Niesz
(74) *Attorney, Agent, or Firm* — McCarter & English, LLP

(57) ABSTRACT

A device that has a device body defining an opening at one end thereof, a storage chamber within the device body for storing multiple doses of a substance therein, and a sliding stopper, sealing engageable with the device body, through which the chamber is filled. The stopper has a body and a flexible portion, which may be in the form of a plurality of flexible members, extending therefrom. The flexible portion or members are movable between first and second positions. In the first position, during filling, the portion or members are substantially laterally extending from the stopper body and engaging the opening of the device body. Accordingly, the axial position of the stopper with respect to the device body is secured during filling of the chamber therethrough. In the second position, after filling, the portion or members are substantially axially-extending from the stopper body and disengaged from the rim or opening of the device body. Accordingly, the stopper is axially slideable through the body.

5 Claims, 15 Drawing Sheets

(51) Int. Cl.
*B65D 71/50* (2006.01)
*A61J 1/20* (2006.01)

(56) References Cited

U.S. PATENT DOCUMENTS

| | | | |
|---|---|---|---|
| 5,641,004 | A | 6/1997 | Py |
| 6,143,252 | A | 11/2000 | Haxo, Jr. |
| 6,604,561 | B2 | 8/2003 | Py |
| 6,684,916 | B2 | 2/2004 | Py |
| 6,805,170 | B2 | 10/2004 | Py |
| 6,892,906 | B2 | 5/2005 | Py et al. |
| 6,929,040 | B2 | 8/2005 | Py |
| 7,032,631 | B2 | 4/2006 | Py |
| 7,096,896 | B2 | 8/2006 | Py |
| 7,100,646 | B2 | 9/2006 | Py |
| 7,111,649 | B2 | 9/2006 | Py |
| 7,243,689 | B2 | 7/2007 | Py |
| 7,270,158 | B2 | 9/2007 | Py |
| 7,278,553 | B2 | 10/2007 | Py et al. |
| 7,322,491 | B2 | 1/2008 | Py et al. |
| 7,445,033 | B2 | 11/2008 | Py |
| 7,490,639 | B2 | 2/2009 | Py |
| 7,500,498 | B2 | 3/2009 | Py |
| 7,556,066 | B2 | 7/2009 | Py |
| 7,628,184 | B2 | 12/2009 | Py et al. |
| 7,665,923 | B2 | 2/2010 | Py et al. |
| 7,669,390 | B2 | 3/2010 | Py |
| 7,707,807 | B2 | 5/2010 | Py |
| 7,726,352 | B2 | 6/2010 | Py et al. |
| 7,726,357 | B2 | 6/2010 | Py et al. |
| 7,780,023 | B2 | 8/2010 | Py et al. |
| 7,810,529 | B2 | 10/2010 | Py |
| 7,905,257 | B2 | 3/2011 | Py |
| 7,954,521 | B2 | 6/2011 | Py et al. |
| 7,967,034 | B2 | 6/2011 | Py |
| 7,975,453 | B2 | 7/2011 | Py |
| 7,980,276 | B2 | 7/2011 | Py |
| 7,992,597 | B2 | 8/2011 | Py et al. |
| 8,007,193 | B2 | 8/2011 | Py et al. |
| 8,096,333 | B2 | 1/2012 | Py et al. |
| 8,112,972 | B2 | 2/2012 | Py |
| 8,132,695 | B2 | 3/2012 | Py et al. |
| 8,347,923 | B2 | 1/2013 | Py |
| 8,376,003 | B2 | 2/2013 | Py et al. |
| 8,397,950 | B2 | 3/2013 | Py |
| 8,408,256 | B2 | 4/2013 | Py |
| 8,448,674 | B2 | 5/2013 | Py |
| 8,631,838 | B2 | 1/2014 | Py |
| 8,646,243 | B2 | 2/2014 | Py |
| 8,690,468 | B2 | 4/2014 | Py et al. |
| 2008/0118299 | A1 | 5/2008 | Py |
| 2009/0098250 | A1 | 4/2009 | Py |
| 2009/0139953 | A1 | 6/2009 | Py |
| 2010/0094245 | A1 | 4/2010 | Py |
| 2010/0236659 | A1 | 9/2010 | Py et al. |
| 2011/0084098 | A1 | 4/2011 | Py |
| 2011/0277873 | A1 | 11/2011 | Py et al. |
| 2012/0261027 | A1 | 10/2012 | Py |
| 2013/0180618 | A1 | 7/2013 | Py |
| 2013/0184677 | A1 | 7/2013 | Py |
| 2013/0190704 | A1 | 7/2013 | Py |

FOREIGN PATENT DOCUMENTS

| | | | |
|---|---|---|---|
| WO | WO2005/046755 | A2 | 5/2005 |
| WO | WO2005/072427 | A2 | 8/2005 |
| WO | WO2006/037112 | A2 | 4/2006 |
| WO | WO2006/063000 | A2 | 6/2006 |
| WO | WO2011/044531 | A1 | 4/2011 |
| WO | WO2011/137413 | A1 | 11/2011 |
| WO | WO2012/145434 | A1 | 10/2012 |
| WO | WO2012/177933 | A1 | 12/2012 |
| WO | WO2013/155369 | A1 | 10/2013 |
| WO | WO2013/158756 | A1 | 10/2013 |
| WO | WO2013/166143 | A1 | 11/2013 |
| WO | WO2013/188703 | | 12/2013 |

DEVICE WITH SLIDING STOPPER AND RELATED METHOD

CROSS-REFERENCE TO RELATED APPLICATION

This patent application claims benefit under 35 U.S.C. §119 to similarly-titled U.S. Provisional Patent Application No 61/799,423, filed Mar. 15, 2013, which is hereby incorporated by reference in its entirety as part of the present disclosure.

FIELD OF THE INVENTION

The present invention relates to devices for storing a substance therein and having a stopper mounted thereon, and particularly to devices having sliding stoppers.

BACKGROUND OF THE INVENTION

A typical prior art container that stores a substance to be dispensed therein, such as a vial for example, includes a rigid body having a chamber therein for storing the substance to be dispensed. However, when the chamber is sealed, air cannot enter therein to replace the volume of the dispensed substance. Thus, the storage chamber can have a variable-volume storage chamber, in order to reduce the volume thereof with each dispensed dosage and prevent suction forces.

One approach to providing a variable-volume storage chamber is to provide a flexible chamber within the device body, which is deformable with each dispensed dose. However, such a design generally requires additional manufacturing and assembly steps, such as, for example, extruding a chamber parison from a polymer, blow molding the parison into a flexible chamber, and then assembling the chamber within the device body. To avoid the extra manufacturing and assembly steps, and thus, extra expense, several devices utilize the volume within rigid body itself as the storage chamber.

As the rigid body is not deformable, some devices mount a sliding stopper to the body, which is slideable within the body upon dispensing of a dose of substance, to correspondingly reduce the volume of the storage chamber. Some of these devices also fill the chamber through the stopper. One drawback associated with such sliding stoppers is that they may slide while filling therethrough, thereby reducing the volume of the chamber, and reducing the amount of doses than can be filled therein.

SUMMARY OF THE INVENTION

It is an object of the present invention to overcome one or more of the above-described drawbacks and/or disadvantages of the prior art In accordance with a first aspect, a device for storing a substance to be dispensed, comprises a device body defining an opening at one end thereof, a storage chamber within the device body for storing a substance therein; and a sliding stopper, sealingly engageable within the device body. The stopper has a stopper body adapted for filling the substance into the storage chamber therethrough and a flexible portion or a plurality of flexible members extending from the stopper body, wherein the flexible portion or members are movable between (i) a first position, wherein the flexible portion or members are substantially laterally extending from the stopper body and engaging the opening of the device body, thereby securing the axial position of the stopper with respect to the device body during filling of the chamber therethrough, and (ii) a second position, wherein the flexible portion or members are substantially axially-extending from the stopper body and substantially disengaged from the opening of the device body, thereby allowing the stopper to slide axially through the body.

In some embodiments, the device body is an elongated body defining a sidewall, and the sliding stopper further comprises first and second axially-spaced sealing members extending about the stopper body and configured to sealingly engage an interior surface of the device body sidewall and permit sliding movement of the stopper relative to the device body. In some such embodiments, the device body defines an annular sidewall, the sliding stopper defines an annular stopper body, and the first and second sealing members extend annularly about the stopper body. In other such embodiments, the first and second sealing members are flexible relative to the device body and form an interference fit with the sidewall to form a fluid-tight seal therebetween. In yet other such embodiments, the flexible members and the first and second sealing members comprise the same material. In some such embodiments, the flexible members and the first and second sealing members comprise a thermoplastic elastomer or a silicone material. In other such embodiments, the stopper body is made of a polymer substantially bondable to the flexible members and the first and second sealing members. In some such embodiments, the flexible members and the first and second sealing members are over-molded onto the stopper body.

In some embodiments, the flexible members are bendable between the first laterally-extending position and the second axially-extending position about a living hinge thereof. In some embodiments, the plurality of flexible members comprise a plurality of angularly spaced petals.

In some embodiments, the sliding stopper further comprises a penetrable and resealable septum that is penetrable by a needle or like filling or injection member for filling the storage chamber with multiple doses of the substance and resealable to hermetically seal a resulting penetration aperture in the septum. In some such embodiments, the septum is resealable by at least one of (i) the application of a liquid sealant thereto, (ii) the application of radiation or energy thereto, and (iii) the application of a mechanical seal thereto.

In some embodiments, the device further comprises a one-way valve connectable in fluid communication with a delivery device, wherein the one-way valve (i) permits substance from the storage chamber to flow there-through and into delivery device connected in fluid communication therewith, and (ii) substantially prevents any fluid flow in a substantially opposite direction there-through and into the storage chamber. In some such embodiments, the one-way valve includes a relatively rigid valve seat and an elastic valve member engaging the valve seat and defining a normally closed, axially-elongated, valve seam therebetween that substantially prevents the passage of fluid therethrough when a pressure differential across the valve is less than a valve opening pressure, and allows the passage of fluid therethrough a pressure differential across the valve exceeds the valve opening pressure. In other such embodiments, the storage chamber is a variable-volume storage chamber defined between the one-way valve and the sliding stopper. In some such embodiments, the storage chamber is a sealed, sterile, storage chamber.

In some embodiments, the device further comprises a connector located adjacent to an outlet of the one-way valve, wherein the connector is adapted to connect thereto the delivery device.

In some embodiments, the device further comprises a cap configured to mount into the opening of the device body and move the flexible members from the first, laterally-extending, position to the second, axially-extending, position.

In accordance with another aspect, a device for storing multiple doses of a substance to be dispensed, comprises a device body defining an opening at one end thereof; first means within the device body for storing multiple doses of a substance therein; and second means for sealing one end of the first means and filling the substance into the first means therethrough, slidably engageable within the device body, having third means for engaging the opening of the device body during filling of the first means therethrough. The third means is movable between (i) a first position, wherein the third means substantially laterally extends and engages the opening of the device body, thereby securing the axial position of the second means with respect to the device body during filling, and (ii) a second position, wherein the third means substantially axially-extends and is substantially disengaged from the opening of the device body, thereby allowing the second means to slide axially through the body.

In some embodiments, the first means is a storage chamber, the second means is a sliding stopper having a rigid body, and the third means is a flexible portion or plurality of member extending from the sliding stopper body.

In accordance with another aspect, a method of filling a device comprises the steps of (i) providing a device comprising a device body defining an opening at one end thereof and a storage chamber within the device body for storing multiple doses of a substance therein, and a sliding stopper, sealingly received within the opening of device body, having a stopper body and a flexible portion or plurality of flexible members extending from the stopper body and oriented in a laterally-extending position, to, in turn, engage the opening of the device body, (ii) releasably securing the flexible portion or plurality of flexible members to the opening, and, in turn, securing the axial position of the stopper with respect to the device body, (iii) filling the storage chamber through the sliding stopper; (iv) moving the flexible member or plurality of flexible members from the laterally-extending position into an axially-extending position, to, in turn, substantially disengaged from the opening and permit the stopper to slide axially through the device body, and (v) incrementally sliding the stopper through the device body.

In some embodiments, the sliding stopper further comprises a penetrable and resealable septum, and the filling step comprises penetrating the septum by a needle or like filling or injection member, filling the storage chamber with multiple doses of the substance, withdrawing the needle or like filling or injection member from the septum, and further comprising the step of hermetically sealing a resulting penetration aperture in the septum.

In some embodiments, the device further comprises a one-way valve connectable in fluid communication with a delivery device, wherein the one-way valve (i) permits substance from the storage chamber to flow there-through and into delivery device connected in fluid communication therewith, and (ii) substantially prevents any fluid flow in a substantially opposite direction there-through and into the storage chamber, and the method further comprises the steps of connecting the one-way valve with a delivery device and dispensing a dose of the substance from the storage chamber through the one-way valve; and wherein the sliding step comprises sliding the stopper within the plunger to correspondingly reduce the volume of the storage chamber.

In some embodiments, the sliding stopper further comprises first and second axially-spaced sealing members extending about the stopper body and configured to sealingly engage an interior surface of the device body and allow sliding movement of the stopper relative to the device body.

In accordance with another aspect, a filling apparatus comprises a frame having axially spaced upper and lower laterally-extending frame members attached via first and second axially-elongated, laterally spaced supports, wherein the upper frame member defines at least one slot and device support member extending therefrom toward the lower frame member dimensioned to receive a device to be filled therein such that an end of the device is substantially flush with the upper frame member. A filling device support is positioned above the frame and includes at least one module, at least one respective first plate, and at least one respective second plate, axially aligned with one another, and a filling device mounted between each of the at least one module and first plate. The module, first plate and second plate are movable with respect to one another and with respect to the frame between (i) an initially disengaged position, wherein the first plate is axially spaced from the module, the second plate is axially spaced from the first plate, and the upper frame member is axially spaced from the second plate, (ii) a first engaged position, wherein the first plate is axially spaced from the module, the second plate is axially spaced from the first plate, and the second plate is engaged with the upper frame member, (iii) a second engaged position, wherein the first plate is axially spaced from the module, the first plate is engaged with the second plate, and the second plate is engaged with the upper frame member, and (iv) a third and fully engaged position, wherein the module is engaged with the first plate, the first plate is engaged with the second plate, and the second plate is engaged with the upper frame member.

In some embodiments, the filling device comprises a hollow filling member, a tip formed at one end of the filling member, at least one port in fluid communication with the interior of the hollow filling member, and a closure, wherein at least one of the closure and filling member is movable between (i) a first position wherein the closure closes the at least one port and forms a fluid-tight seal between the at least one port and ambient atmosphere to maintain sterility of the at least one port and an interior of the filling member, and (ii) a second position opening the at least one port.

In some embodiments, the closure and/or filling member is in the first position when the module, first plate and second plate are in the disengaged position, the first engaged position or the second engaged position.

In some embodiments, the closure and/or filling member is in the second position when the module, first plate and second plate are in the third and fully engaged position.

In some embodiments, the second plate engages the end of the device in the first, second and third engaged positions.

Other objects and advantages of the present invention, and/or of the currently preferred embodiments thereof, will become more readily apparent in view of the following detailed description of currently preferred embodiments and accompanying drawings.

DETAILED DESCRIPTION OF EMBODIMENTS OF THE INVENTION

Figure 1:
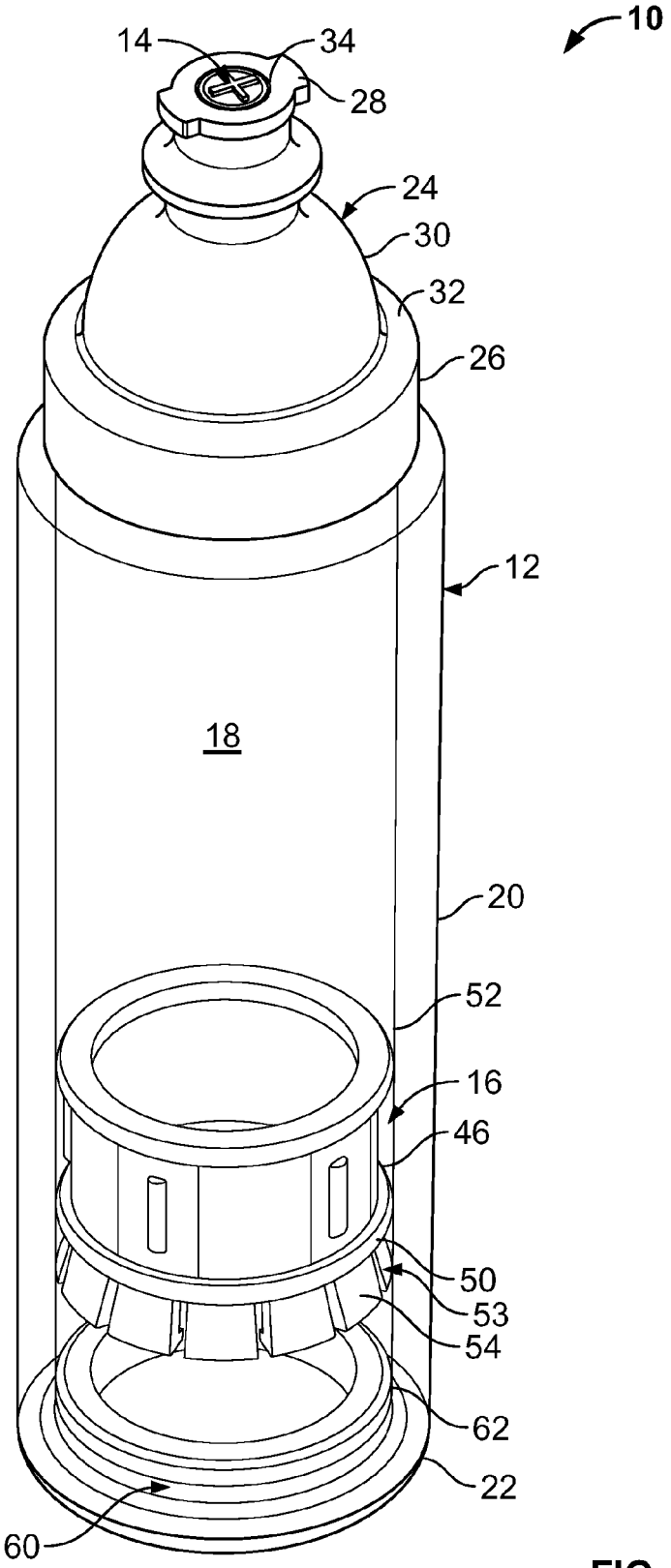
FIG. 1 is a perspective side view of a device with a sliding stopper.
Figure 2:
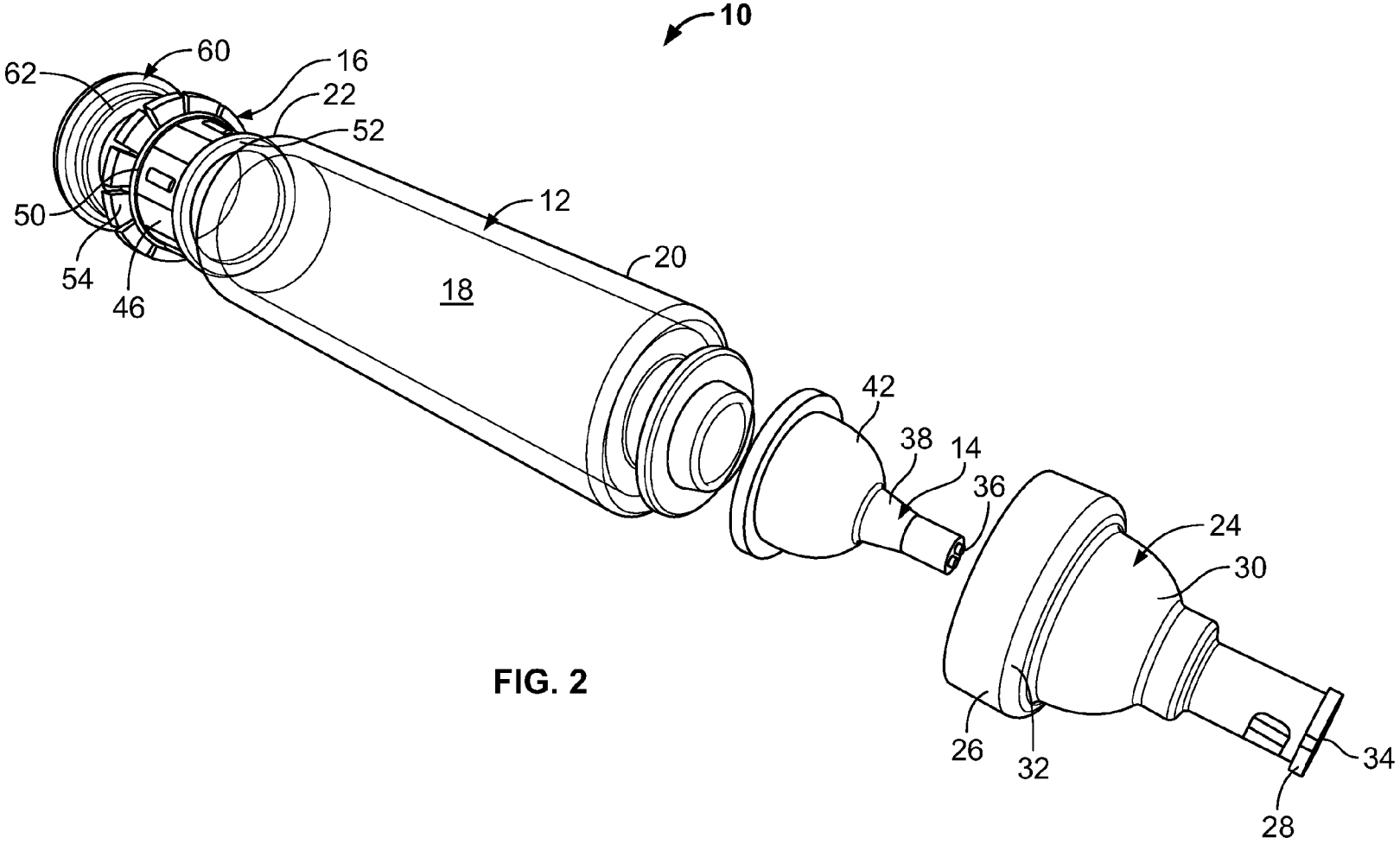
FIG. 2 is a exploded view of the device of FIG. 1.
Figure 4:
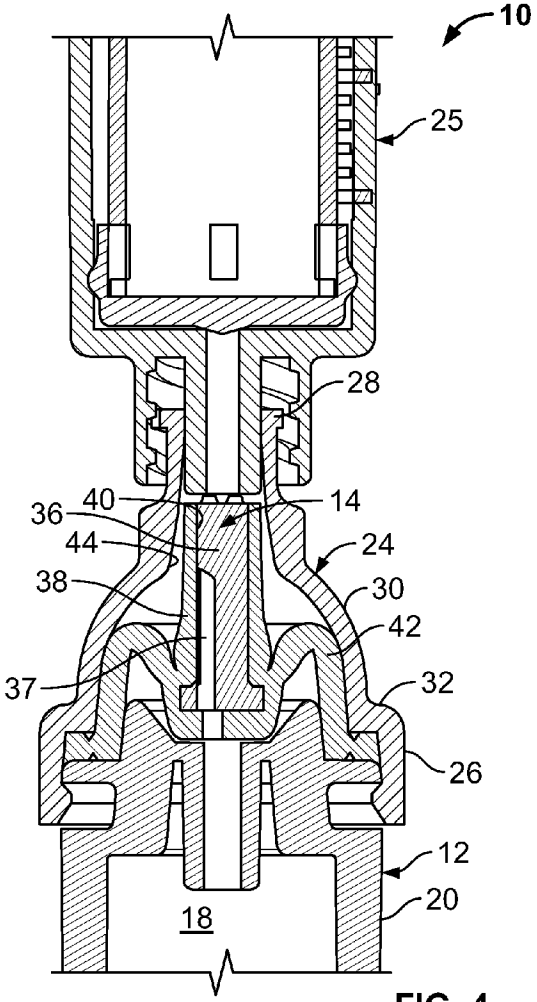
FIG. 4 is a partial cross-sectional side view of the device of FIG. 1 and a syringe delivery device connected to the one-way valve for withdrawing one or more doses of the stored substance from the variable-volume storage chamber of the device.

In FIGS. 1-5, a device is indicated generally by the reference numeral 10. In the illustrated embodiment, the device 10 is a container, such as, for example, but not limited to, a vial. The device 10 comprises a body 12, a one-way valve 14 located at one end of the body 12, and a sliding stopper 16 initially located at an opposing end of the body 12. The body 12 includes a sealed empty variable-volume storage chamber 18 therein, defined between the valve 14 and the sliding stopper 16, for storage of a substance, such as a multiple doses of medicament, pharmaceutical injectable, or vaccine. As may be recognized by those of ordinary skill in the pertinent art based on the teachings herein, the invention may be embodied in and otherwise may be applicable to any of numerous different types of devices that are currently known or that later become known, such as other containers, syringes, delivery devices, dispensers and processing devices. The devices may also be filled with any of numerous different substances that are currently known or that later become known, such as supplements, foods, beverages, liquid nutrition products, and industrial products, and in any of numerous different forms, including liquids, gels, powders and gases.

In the illustrated embodiment, the body 12 defines a substantially cylindrical side wall 20, and defines an opening 22 at a base end thereof. A connector 24 is sealingly mounted atop the opposing valve end of the body 12. In some embodiments, the body 12 is formed of a glass or plastic material. However, as may be recognized by those of ordinary skill in the pertinent art, the body may be made of any of numerous different materials that are currently known or that later become known. The connector 24 includes an annular base member 26 at a base end thereof, sealingly engaging the side wall 20 of the body 12, and a connector tip 28, e.g., a male Luer connector tip, at an opposing end thereof. An approximately dome-shaped member 30 extends therebetween. The connector 24 defines an annular shoulder 32 at the interface of the annular base member 26 and the dome-shaped member 30. The connector 24 further defines a valve opening 34 extending therethrough for receiving the one-way valve 14.

Figure 3:
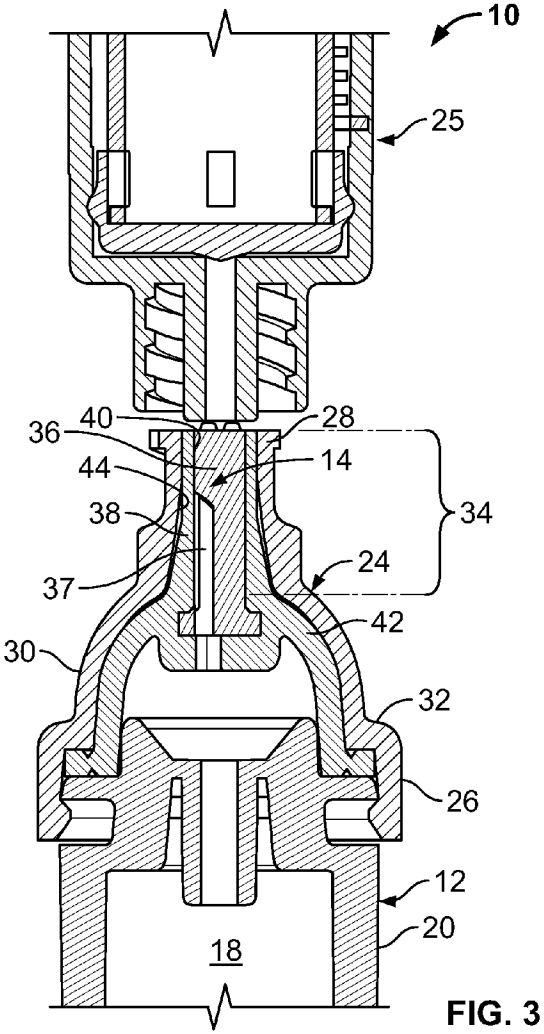
FIG. 3 is a partial cross-sectional side view of the device of FIG. 1 and a syringe delivery device connectable to the one-way valve for withdrawing one or more doses of the stored substance from the variable-volume storage chamber of the device.
Figure 6:
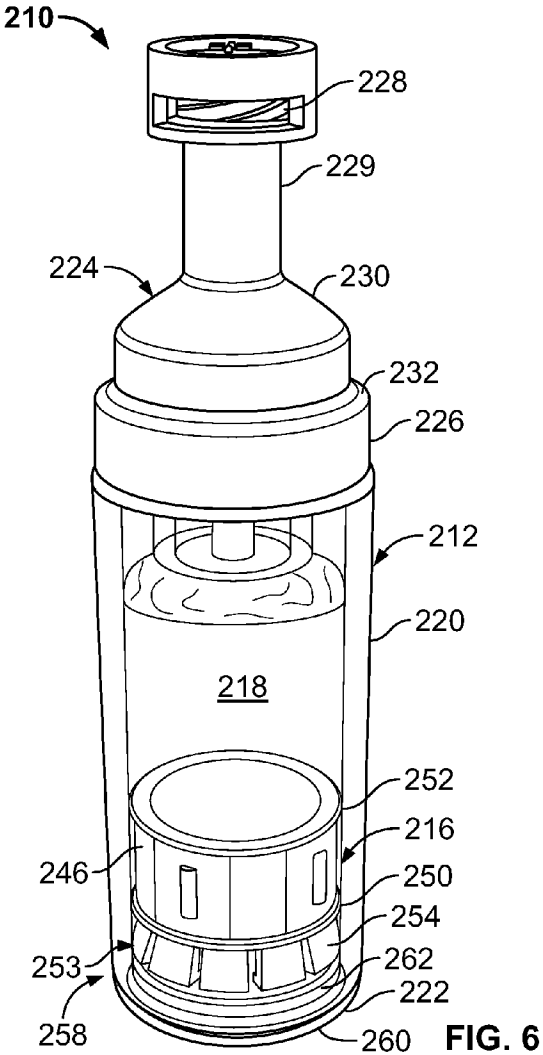
FIG. 6 is a perspective side view of another embodiment of a device with a sliding stopper.

As best shown in FIG. 3 the one-way valve 14 includes a relatively rigid valve seat 36 that is received within, and retained by, a flexible valve member or cover 38 such that a normally closed, axially elongated annular valve seam 40 is defined therebetween. The flexible valve member 38 defines a substantially dome-shaped spring 42 formed of a resilient and/or elastomeric material. The spring 42 deforms to permit the valve member 38 and valve seat 36 to move axially within the connector 24 between an extended, first position (FIG. 3), wherein the valve member 38 is fully received within the valve opening 34 of the connector 24, and a depressed second position (FIG. 4) wherein the valve member 38 is depressed or otherwise moved distally within the valve opening 34 and substantially out of engagement with the interior surface 44 of the connector 24. The dome-shaped spring 42 normally biases the valve 14 in the direction from the depressed second position toward the extended first position.

The valve 14 is engageable by a delivery device 25, such as, for example, by a syringe, and moveable from the extended first position to the depressed second position. When in the first position, the interior surface 44 of the connector 24 forming the valve opening 34 surrounds or engages the valve member 38 or otherwise substantially prevents expansion or movement of the valve member relative to, e.g., away from, the valve seat 36, thereby preventing the valve 14 from opening. The annular valve seam 40 is closed, thereby preventing the passage of the substance therethrough. When in the second position, on the other hand, the one-way valve 14 is disengaged from the interior surface 44 with sufficient space around it (e.g., by the outward taper or expansion of the connector 24) so that the valve 14 is moveable between the normally-closed position and an open position. Specifically, the surrounding space allows the valve member 38 to move away from the valve seat 36 and open the valve seam 40. In the normally-closed position, the valve member 38 engages with the valve seat 36 to form a fluid-tight seal therebetween and, in turn, maintain the substance within the storage chamber 18 in a sterile and hermetically sealed condition. The valve member 38 and valve seat 36 can define an interference fit between them. The valve 14 defines a valve opening pressure and remains in the normally-closed position unless a pressure differential across the valve 14 (e.g., from internally to externally of the valve 14) exceeds the valve opening pressure. When a pressure differential across the valve exceeds the valve 14 opening pressure, the valve member 38 is expanded, e.g., radially, relative to the valve seat 36. Thus, the valve seam 40 therebetween is opened and, in turn, allows a substance to be withdrawn from the variable-volume storage chamber 18 and dispensed out of the device 10 through the valve 14.

The valve opening pressure is defined, in part, as a function of the length of the engagement of the valve member 38 with the valve seat 36, i.e., the axial extent of the valve seam 40. The greater the length thereof, the greater the total force required to move the valve seat and the greater the valve opening pressure. As shown, the valve seat 36 defines at least one elongated groove 37 therein. Thus, the valve member 38 need not be displaced at the groove(s) 37 for the fluid to flow between the valve seat 36 and the valve member 38. Accordingly, the length, and number, of the groove(s) 37 effectively reduces the length of the valve seam 40 and thus effectively reduces the valve opening pressure of the valve 14. The length and number of the groove(s) 37 are configured, in consideration of the properties of the valve member 38, e.g., its elasticity, thickness, shape, etc., such that a delivery device 25 engaging the valve 14 and utilized in a normal manner, e.g., withdrawing a plunger from a barrel of a syringe engaging the valve, is capable of creating a pressure differential across the valve that exceeds the valve opening pressure, and this opens the valve seam 40. Conversely, these features are configured to maintain a minimum valve opening pressure to prevent unintentional opening, as should be understood by one of ordinary skill in the pertinent art.

In the open position, the one-way valve 14 (i) permits substance to flow out of the storage chamber 18 there-through, and (ii) substantially prevents any fluid flow in a substantially opposite direction there-through and into the storage chamber 18, to thereby maintain the substance sterile, aseptic and/or contamination free, in accordance with the teachings of U.S. patent application Ser. No. 13/744,379 filed Jan. 17, 2013, entitled "Multiple Dose Vial and Method," which, in turn, claims the benefit of similarly titled U.S. Provisional Patent Application No. 61/587,525, filed Jan. 17, 2012, each of which is hereby expressly incorporated by reference in its entirety as part of the present disclosure.

Figure 5:
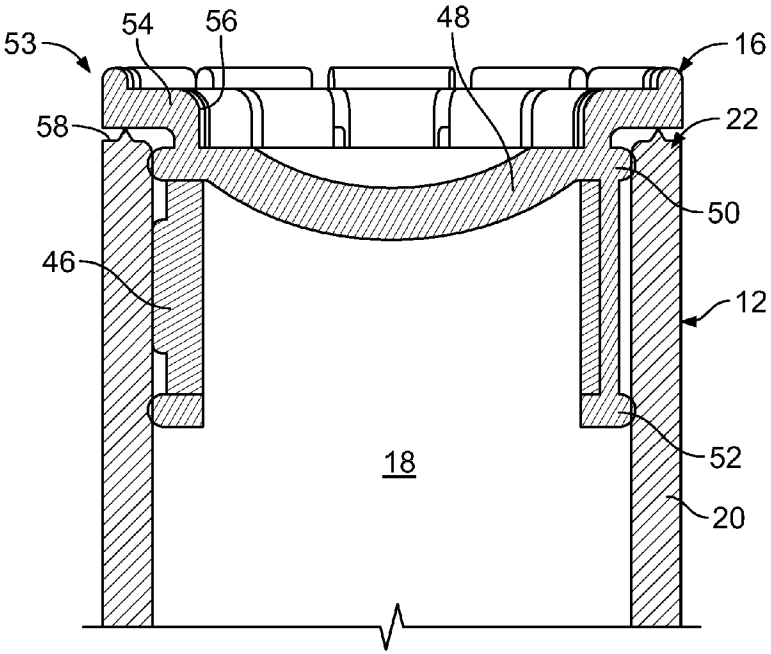
FIG. 5 is an enlarged, cross-sectional view of the sliding stopper of the device of FIG. 1.

The sliding stopper 16 is initially mounted at the base opening 22 of the device body 12 as seen in FIG. 5, and the device 10 is filled therethrough. The stopper 16 includes a substantially cylindrical rigid body 46 defining a penetrable and resealable septum 48 that is penetrable by a needle or like filling or injection member, as described below, for sterile or aseptically filling the storage chamber 18 with multiple doses of the substance to be stored therein. The sliding stopper 16 also includes relatively flexible proximal and distal annular sealing members 50, 52 at opposing ends of the rigid body 46. The two axially spaced sealing members 50, 52 are dimensioned, relative to the interior dimensions, e.g., diameter, of the device body 12, to create a seal therebetween. In some embodiments, the dimensions can be selected to create a dimensional interference therewith. That is, the dimensions of the sealing members 50, 52 are slightly greater than the interior dimensions of the device body 12, thereby forming an interference fit with the device body 12. In some embodiments, the diameter of the sealing members 50, 52 is within the range of about 0.1 mm to about 0.3 mm greater than the interior diameter of the device body 12. Thus, the sealing members 50, 52 form a sliding, fluid-tight seal between the sliding stopper 16 and the device body 12. The substantially rigid nature of the stopper body 46 prevents distortion or collapsing of the stopper body 46, which could compromises its seal with the device body 12.

The sealed empty chamber 18 is defined within the device body 12, between the mounted stopper 16 and the valve 14. Though the illustrated embodiment uses a valve to seal the end of the body 12, the invention contemplates any manner of sealing the end of the body 12 and forming a storage chamber with the stopper 16. If the stopper 16, body 12, and valve 14 are sterilized, a sealed, empty, sterile chamber 18 is thus defined therein. Sterilization of the stopper, body, and valve and/or any component parts therein may be achieved in accordance with the teachings of any of the following patents and patent applications, each of which is hereby expressly incorporated by reference in its entirety as part of the present disclosure as if fully set forth herein: U.S. patent application Ser. No. 08/424,932, filed Apr. 19, 1995, entitled "Process for Filling a Sealed Receptacle under Aseptic Conditions," issued as U.S. Pat. No. 5,641,004; U.S. patent application Ser. No. 09/781,846, filed Feb. 12, 2001, entitled "Medicament Vial Having a Heat-Sealable Cap, and Apparatus and Method for Filling Vial," issued as U.S. Pat. No. 6,604,561, which, in turn, claims priority from U.S. Provisional Patent Application Ser. No. 60/182,139, filed Feb. 11, 2000, entitled "Heat-Sealable Cap for Medicament Vial;" U.S. patent application Ser. No. 10/655,455, filed Sep. 3, 2003, entitled "Sealed Containers and Methods of Making and Filling Same," issued as U.S. Pat. No. 7,100,646, which, in turn, claims priority from similarly titled U.S. Provisional Patent Application Ser. No. 60/408,068, filed Sep. 3, 2002; and U.S. patent application Ser. No. 10/766,172, filed Jan. 28, 2004, entitled "Medicament Vial Having a Heat-Sealable Cap, and Apparatus and Method for Filling the Vial," issued as U.S. Pat. No. 7,032,631, which, in turn claims priority from similarly titled U.S. Provisional Patent Application Ser. No. 60/443,526, filed Jan. 28, 2003 and similarly titled U.S. Provisional Patent Application Ser. No. 60/484,204, filed Jun. 30, 2003. In addition, the sealed empty chamber may be sterilized prior to filling with a fluid sterilant as disclosed in U.S. Provisional Patent Application Ser. No. 61/499,626, filed Jun. 21, 2011, entitled "Nitric Oxide Injection Sterilization Device and Method," which is hereby expressly incorporated by reference in its entirety as part of the present disclosure as if fully set forth herein.

As best shown in FIGS. 1 and 5, the sliding stopper 16 further includes a flexible portion 53 extending from the proximal end thereof, i.e., the end closest to the opening 22. In some embodiments, the flexible portion 53 includes a plurality of flexible and angularly spaced members 54, e.g., petals. In some embodiments, the sealing members 50, 52 and petals 54 are made of a thermoplastic elastomer, such as, for example low and/or high density polyethylene. In some such embodiments, the thermoplastic elastomer defines a durometer within the range of about 20 shore A to about 95 shore A. In some embodiments, the sealing members 50, 52 and petals 54 are formed of a silicone material. In some of these embodiments, the sealing members 50, 52 and petals 54 are overmolded onto the rigid body 46 made of a substantially bondable polymer, such as, for example, glass-filled PBT. However, as should be recognized by those of ordinary skill in the pertinent art, the sealing members, petals, and body of the stopper may be formed of any of numerous different materials, currently known, or that later become known, capable of bonding with one another and performing the functions of the individual parts as described herein. As also should be understood by those of ordinary skill in the pertinent art, the sealing members and petals may be integrally formed with the body. For example, the sealing members may be formed as laterally-extending annular protuberances on the body, or may be formed by sealing members, such as o-rings or other sealing members, that are received within corresponding grooves or recesses formed in the body.

The flexible member 53, e.g., flexible petals 54, is bendable. e.g., about a living hinge 56 thereof, between a substantially laterally-extending position (FIG. 5) and an axially-extending position (FIG. 1). As shown in FIG. 5, the flexible portion 53 is positioned in the laterally-extending position, when the stopper 16 is initially mounted at the opening 22 of the device body 12, and prior to filling therethrough. In the substantially laterally-extending position, the flexible portion 53, e.g., the petals 54, engages the annular rim 58 defining the opening 22 at the base end of the body 12. The laterally-extending petals 54, or other configuration of flexible portion 53, in engagement with the annular rim 58, fixedly secure the axial position of the sliding stopper 16 relative to the device body 12 during filling of the variable-volume storage chamber 18 therethrough.

After filling the storage chamber 18 through the penetrable and resealable septum 48, the stopper 16 is depressed or withdrawn into the chamber 18. As the stopper 16 is depressed or drawn into the chamber, the annular rim 58 of the opening 22 bends the flexible portion 53, e.g., the petals 54, inwardly about the living hinge(s) 56 thereof, and, in turn, moves the flexible portion 53 or petals 54 into the axially-extending position. In the axially-extending position, the flexible portion 53 or petals 54 are out of engagement with the annular rim 58, as shown in FIG. 1. This, in turn, enables the sliding stopper 16 to move axially within the device body 12 and thereby accommodate reductions in the volume of the storage chamber 18 upon dispensing doses of the stored substance therefrom, as described further below. A cap 60 can then be inserted into the base opening 22 of the device body 12 to close the opening. In some embodiments, the insertion of the cap 60 may axially depress the stopper 16 into the chamber 18. The cap 60 includes an annular projection 62 positioned to engage the interior surface of the device body sidewall 20 when the cap 60 is mounted. The cap 60 can include one or more vent apertures (not shown) to prevent the formation of a vacuum between the sliding stopper 16 and the cap 60, and otherwise to allow the sliding stopper 16 to travel through the device body 12 upon dispensing the substance from the storage chamber 18. That is, when the stopper 16 moves along the body 12, it creates a suction in the space between the stopper 16 and cap 60. The vents allow air into the space to equalize the pressure.

The manner in which the sliding stopper 16 cooperates with the device body 12 to define the variable-volume storage chamber 18 may be the same as or substantially similar to that disclosed in any of the following patents and patent applications, each of which is hereby expressly incorporated by reference in its entirety as part of the present disclosure: U.S. patent application Ser. No. 13/219,597, filed Aug. 26, 2011, entitled "Laterally-Actuated Dispenser with One-Way Valve For Storing and Dispensing Substances," which is a continuation of U.S. patent application Ser. No. 12/710,516, filed Feb. 23, 2010, entitled "Laterally-Actuated Dispenser with One-Way Valve for Storing and Dispensing Metered Amounts of Substances," now U.S. Pat. No. 8,007,193, which is a continuation of similarly titled U.S. patent application Ser. No. 11/237,599, filed Sep. 27, 2005, now U.S. Pat. No. 7,665,923, which, in turn, claims the benefit of similarly titled U.S. Provisional Patent Application Ser. No. 60/613,583, filed Sep. 27, 2004, and similarly titled U.S. Provisional Application No. 60/699,607 filed Jul. 15, 2005.

The septum 48 may be penetrated for sterile filling the variable-volume storage chamber 18 therethrough. The septum 48 is preferably formed of a material that is sufficiently elastic to self-close after withdrawal of the filling member therefrom to thereby ensure that the head loss left by a residual penetration hole after the filling member is withdrawn prevents fluid ingress therethrough. Although the septum 48 is preferably self-closing, the septum may be resealed, such as by the application of radiation or energy thereto, e.g., laser radiation or energy, to hermetically seal the filled substance within the storage chamber 18 from the ambient atmosphere, in accordance with the teachings of any of the following patents and patent applications, each of which is hereby expressly incorporated by reference in its entirety as part of the present disclosure: U.S. patent application Ser. No. 12/254,789, filed Oct. 20, 2008, entitled "Container Having a Closure and Removable Resealable Stopper for Sealing a Substance Therein and Related Method," which, in turn, claims the benefit of U.S. patent application Ser. No. 60/981,107, filed Oct. 18, 2007, entitled "Container Having a Closure and Removable Resealable Stopper for Sealing a Substance Therein;" U.S. patent application Ser. No. 12/245,678, filed Oct. 3, 2008, entitled "Apparatus For Formulating and Aseptically Filling Liquid Products," and U.S. patent application Ser. No. 12/245,681, filed Oct. 3, 2008, entitled "Method For Formulating and Aseptically Filling Liquid Products," which, in turn, claim the benefit of U.S. patent application Ser. No. 60/997,675, filed Oct. 4, 2007, entitled "Apparatus and Method for Formulating and Aseptically Filling Liquid Products;" U.S. patent application Ser. No. 12/875,440, filed Sep. 3, 2010, entitled "Device with Needle Penetrable and Laser Resealable Portion and Related Method," now U.S. Pat. No. 7,980,276, which is a divisional of U.S. patent application Ser. No. 12/371,386, filed Feb. 13, 2009, entitled "Device with Needle Penetrable and Laser Resealable Portion," now U.S. Pat. No. 7,810,529, which is a continuation of U.S. patent application Ser. No. 11/949,087, filed Dec. 3, 2007, entitled "Device with Needle Penetrable and Laser Resealable Portion and Related Method," now U.S. Pat. No. 7,490,639, which is a continuation of similarly titled U.S. patent application Ser. No. 11/879,485, filed Jul. 16, 2007, now U.S. Pat. No. 7,445,033, which is a continuation of similarly titled U.S. patent application Ser. No. 11/408,704, filed Apr. 21, 2006, now U.S. Pat. No. 7,243,689, which is a continuation of U.S. patent application Ser. No. 10/766,172, filed Jan. 28, 2004, entitled "Medicament Vial Having a Heat-Sealable Cap, and Apparatus and Method for Filling the Vial," now U.S. Pat. No. 7,032,631, which is a continuation-in-part of similarly titled U.S. patent application Ser. No. 10/694,364, filed Oct. 27, 2003, now U.S. Pat. No. 6,805,170 which is a continuation of similarly titled U.S. patent application Ser. No. 10/393,966, filed Mar. 21, 2003, now U.S. Pat. No. 6,684,916, which is a divisional of similarly titled U.S. patent application Ser. No. 09/781,846, filed Feb. 12, 2001, now U.S. Pat. No. 6,604,561, which, in turn, claims the benefit of similarly titled U.S. Provisional Patent Application Ser. No. 60/182,139, filed Feb. 11, 2000, and similarly titled U.S. Provisional Patent Application Ser. No. 60/443,526, filed Jan. 28, 2003, and similarly titled U.S. Provisional Patent Application Ser. No. 60/484,204, filed Jun. 30, 2003; U.S. patent application Ser. No. 13/193,662, filed Jul. 29, 2011, entitled "Sealed Contained and Method of Filling and Resealing Same," which is a continuation of U.S. patent application Ser. No. 12/791,629, filed Jun. 1, 2010, entitled "Sealed Containers and Methods of Making and Filling Same," now U.S. Pat. No. 7,992,597, which is a divisional of U.S. patent application Ser. No. 11/515,162, filed Sep. 1, 2006, entitled "Sealed Containers and Methods of Making and Filling Same," now U.S. Pat. No. 7,726,352, which is a continuation of U.S. patent application Ser. No. 10/655,455, filed Sep. 3, 2003, entitled "Sealed Containers and Methods of Making and Filling Same," now U.S. Pat. No. 7,100,646, which is a continuation-in-part of U.S. patent application Ser. No. 10/393,966, filed Mar. 21, 2003, entitled "Medicament Vial Having A Heat-Sealable Cap, and Apparatus and Method For Filling The Vial," now U.S. Pat. No. 6,684,916, which is a divisional of similarly titled U.S. patent application Ser. No. 09/781,846, filed Feb. 12, 2001, now U.S. Pat. No. 6,604,561, which, in turn, claims the benefit of similarly titled U.S. Provisional Patent Application Ser. No. 60/182,139, filed on Feb. 11, 2000, and U.S. Provisional Patent Application Ser. No. 60/408,068, filed Sep. 3, 2002, entitled "Sealed Containers and Methods Of Making and Filling Same;" U.S. patent application Ser. No. 12/627,655, filed Nov. 30, 2009, entitled "Adjustable Needle Filling and Laser Sealing Apparatus and Method," now U.S. Pat. No. 8,096,333, which is a continuation of similarly titled U.S. patent application Ser. No.

10/983,178, filed Nov. 5, 2004, which, in turn, claims the benefit of U.S. Provisional Patent Application Ser. No. 60/518,267, filed Nov. 7, 2003, entitled "Needle Filling and Laser Sealing Station," and similarly titled U.S. Provisional Patent Application Ser. No. 60/518,685, filed Nov. 10, 2003; U.S. patent application Ser. No. 11/901,467, filed Sep. 17, 2007 entitled "Apparatus and Method for Needle Filling and Laser Resealing," which is a continuation of similarly titled U.S. patent application Ser. No. 11/510,961 filed Aug. 28, 2006, now U.S. Pat. No. 7,270,158, which is a continuation of similarly titled U.S. patent application Ser. No. 11/070,440, filed Mar. 2, 2005; now U.S. Pat. No. 7,096,896, which, in turn, claims the benefit of U.S. Provisional Patent Application Ser. No. 60/550,805, filed Mar. 5, 2004, entitled "Apparatus for Needle Filling and Laser Resealing;" U.S. patent application Ser. No. 12/768,885, filed Apr. 28, 2010, entitled "Apparatus for Molding and Assembling Containers with Stoppers and Filling Same," now U.S. Pat. No. 7,975,453, which is a continuation of similarly titled U.S. patent application Ser. No. 11/074,513, filed Mar. 7, 2005, now U.S. Pat. No. 7,707,807, which claims the benefit of U.S. Provisional Patent Application Ser. No. 60/551,565, filed Mar. 8, 2004, entitled "Apparatus and Method For Molding and Assembling Containers With Stoppers and Filling Same;" U.S. patent application Ser. No. 12/715,821, filed Mar. 2, 2010, entitled "Method for Molding and Assembling Containers with Stopper and Filling Same," which is a continuation of similarly titled U.S. patent application Ser. No. 11/074,454, filed Mar. 7, 2005, now U.S. Pat. No. 7,669,390; U.S. patent application Ser. No. 11/339,966, filed Jan. 25, 2006, entitled "Container Closure With Overlying Needle Penetrable and Thermally Resealable Portion and Underlying Portion Compatible With Fat Containing Liquid Product, and Related Method," now U.S. Pat. No. 7,954,521, which, in turn, claims the benefit of U.S. Provisional Patent Application Ser. No. 60/647,049, filed Jan. 25, 2005, entitled "Container with Needle Penetrable and Thermally Resealable Stopper, Snap-Ring, and Cap for Securing Stopper;" U.S. patent application Ser. No. 12/861,354, filed Aug. 23, 2010, entitled "Ready To Drink Container With Nipple and Needle Penetrable and Laser Resealable Portion, and Related Method;" which is a divisional of similarly titled U.S. patent application Ser. No. 11/786,206, filed Apr. 10, 2007, now U.S. Pat. No. 7,780,023, which, into turn, claims the benefit of similarly titled U.S. Provisional Patent Application Ser. No. 60/790,684, filed Apr. 10, 2006; U.S. patent application Ser. No. 11/295,251, filed Dec. 5, 2005, entitled "One-Way Valve, Apparatus and Method of Using the Valve," now U.S. Pat. No. 7,322,491, which, in turn, claims the benefit of similarly titled U.S. Provisional Patent Application Ser. No. 60/644,130, filed Jan. 14, 2005, and similarly titled U.S. Provisional Patent Application Ser. No. 60/633,332, filed Dec. 4, 2004; U.S. patent application Ser. No. 12/789,565, filed May 28, 2010, entitled "Resealable Containers and Methods of Making, Filling and Resealing the Same," which is a continuation of U.S. patent application Ser. No. 11/933,272, filed Oct. 31, 2007, entitled "Resealable Containers and Assemblies for Filling and Resealing Same," now U.S. Pat. No. 7,726,357, which is a continuation of U.S. patent application Ser. No. 11/515,162, filed Sep. 1, 2006, entitled "Sealed Containers and Methods of Making and Filling Same," now U.S. Pat. No. 7,726,352; U.S. patent application Ser. No. 13/045,655, filed Mar. 11, 2011, entitled "Sterile Filling Machine Having Filling Station and E-Beam Chamber," which is a continuation of U.S. patent application Ser. No. 12/496,985, filed Jul. 2, 2009, entitled "Sterile Filling Machine Having Needle Filling Station and Conveyor," now U.S. Pat. No. 7,905,257, which is a continuation of U.S. patent application Ser. No. 11/527,775, filed Sep. 25, 2006, entitled "Sterile Filling Machine Having Needle Filling Station within E-Beam Chamber," now U.S. Pat. No. 7,556,066, which is a continuation of similarly titled U.S. patent application Ser. No. 11/103,803, filed Apr. 11, 2005, now U.S. Pat. No. 7,111,649, which is a continuation of similarly titled U.S. patent application Ser. No. 10/600,525, filed Jun. 19, 2003, now U.S. Pat. No. 6,929,040, which, in turn, claims the benefit of similarly-titled U.S. Provisional Patent Application Ser. No. 60/390,212, filed Jun. 19, 2002; U.S. patent application Ser. No. 13/326,177, filed Dec. 14, 2011, entitled "Device with Penetrable and Resealable Portion and Related Method," which is a continuation of similarly titled U.S. patent application Ser. No. 13/170,613, filed Jun. 28, 2011, which is a continuation of U.S. patent application Ser. No. 12/401,567, filed Mar. 10, 2009, entitled "Device with Needle Penetrable and Laser Resealable Portion and Related Method," now U.S. Pat. No. 7,967,034, which is a continuation of similarly titled U.S. patent application Ser. No. 11/933,300, filed Oct. 31, 2007, now U.S. Pat. No. 7,500,498; U.S. patent application Ser. No. 13/329,483, filed Apr. 30, 2011, entitled "Ready to Feed Container," which is a continuation of International Application Ser. No. PCT/US2011/034703, filed Apr. 30, 2011, entitled "Ready to Feed Container and Method," which, in turn, claims the benefit of U.S. Provisional Patent Application Ser. No. 61/330,263 filed Apr. 30, 2010; and U.S. Provisional Patent Application Ser. No. 61/476,523, filed Apr. 18, 2011, entitled "Filling Needle and Method."

Alternatively, the septum 48 may be penetrated for sterile filling the variable-volume storage chamber 18 and thereafter resealed with a liquid sealant, such as a silicone sealant, to hermetically seal the filled substance within the storage chamber, in accordance with the teachings of any of the following patent applications, each of which is hereby expressly incorporated by reference in its entirety as part of the present disclosure: U.S. patent application Ser. No. 12/577,126, filed Oct. 9, 2009, entitled "Device with Co-Extruded Body and Flexible Inner Bladder and Related Apparatus and Method," which claims the benefit of similarly titled U.S. Provisional Patent Application Ser. No. 61/104,613, filed Oct. 10, 2008; U.S. patent application Ser. No. 12/901,420, filed Oct. 8, 2010, entitled "Device with Co-Molded One-Way Valve and Variable Volume Storage Chamber and Related Method," which claims the benefit of similarly titled U.S. Provisional Patent Application Ser. No. 61/250,363, filed Oct. 9, 2009; and U.S. Provisional Patent Application Ser. No. 61/476,523, filed Apr. 18, 2011, entitled "Filling Needle and Method."

As should be recognized by those of ordinary skill in the pertinent art, however, the stopper 16 may alternatively employ an inlet valve for filling the variable-volume storage chamber 18 therethrough, such as disclosed, for example, in U.S. Pat. No. 7,278,553, issued, Oct. 9, 2007, entitled "One-Way Valve, Apparatus and Method of Using the Valve," which, in turn, claims the benefit of similarly titled U.S. Provisional Patent Application Ser. No. 60/644,130, filed Jan. 14, 2005, and similarly titled U.S. Provisional Patent Application Ser. No. 60/633,332, filed Dec. 4, 2004; and U.S. Pat. No. 6,892,906, issued, May 17, 2005, entitled "Container and Valve Assembly for Storing and Dispensing Substances, and Related Method," which, in turn, claims the benefit of U.S. Provisional Patent Application Ser. No. 60/442,924, filed Jan. 27, 2003, entitled "Container and Valve Assembly for Storing and Dispensing Substances" and U.S. Provisional Patent Application Ser. No. 60/403,396, filed Aug. 13, 2002, entitled "Container and Valve Assembly for Storing and Dispensing Substances and Method of Making and Filling Same," each of which is hereby expressly incorporated by reference in its entirety as if fully set forth herein.

In FIGS. 6-9, another device is indicated generally by the reference numeral 210. The device 210 is substantially similar to the device 10, described above in connection with FIGS. 1-5, and therefore like reference numerals preceded by the numeral "2" are used to indicate like elements. A primary difference of the device 210 in comparison to the device 10 is that the connector 224 defines an elongated, substantially cylindrical neck 229 between the dome-shaped member 230 and the connector tip 228, and the connector tip 228 defines a tapered inner surface to engage a corresponding tapered outlet end 238*a* of the valve member 238, hereinafter described.

Figure 8:
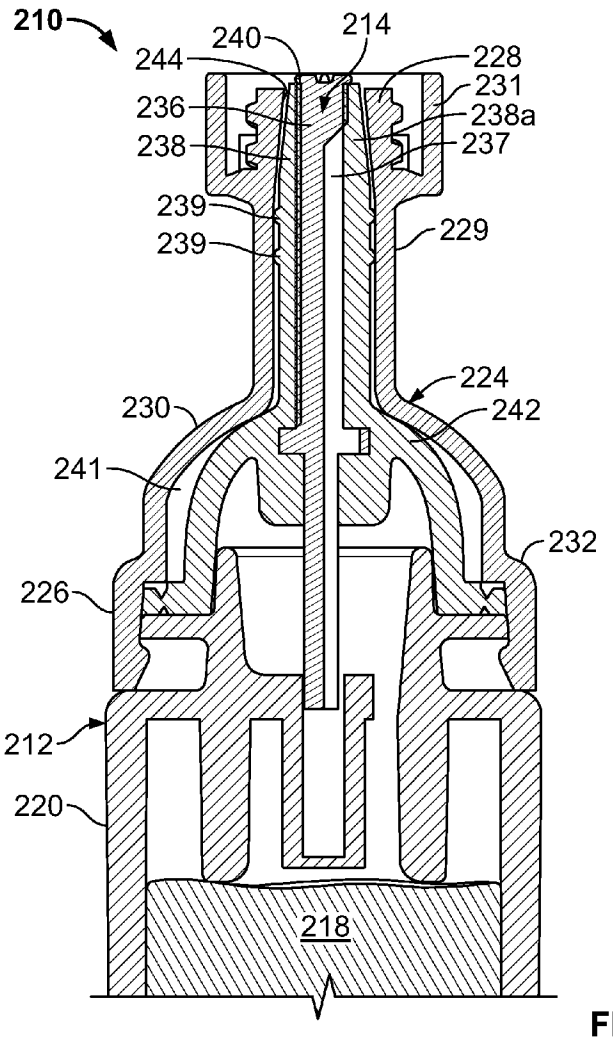
FIG. 8 is an enlarged partial cross-sectional view of the upper portion of the device of FIG. 6.
Figure 7:
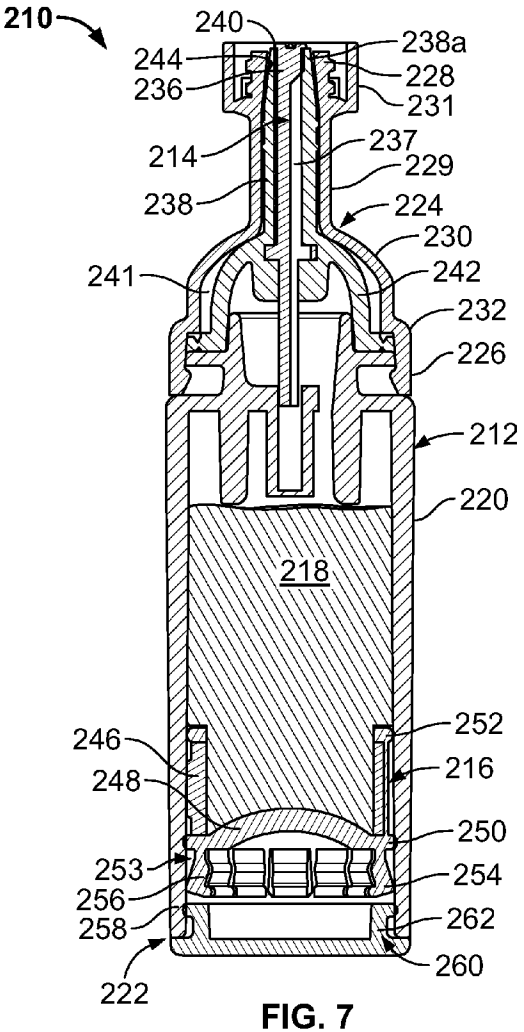
FIG. 7 is cross-sectional side view of the device of FIG. 6.
Figure 9:
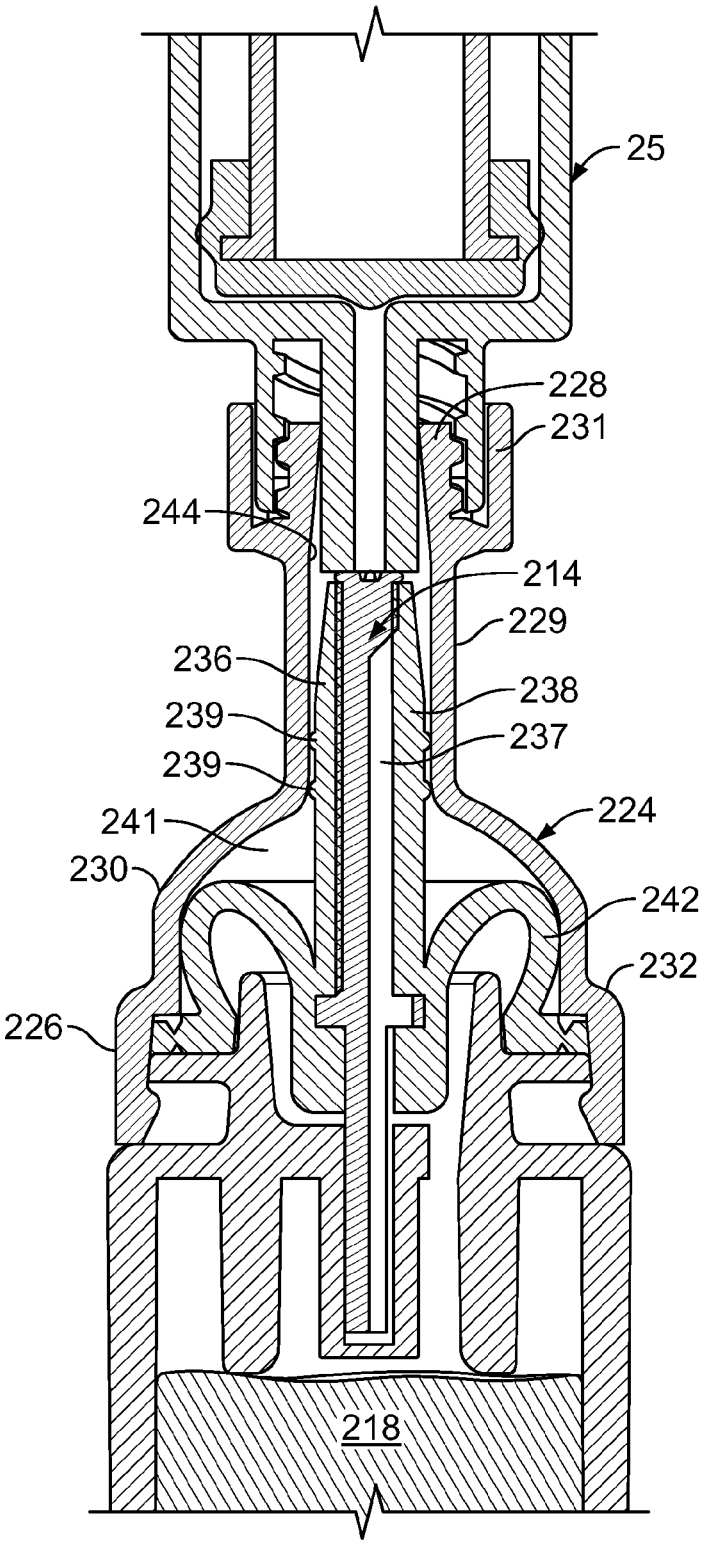
FIG. 9 is a partial cross-sectional side view of the device of FIG. 6 and a syringe delivery device connected thereto.
Figure 10:
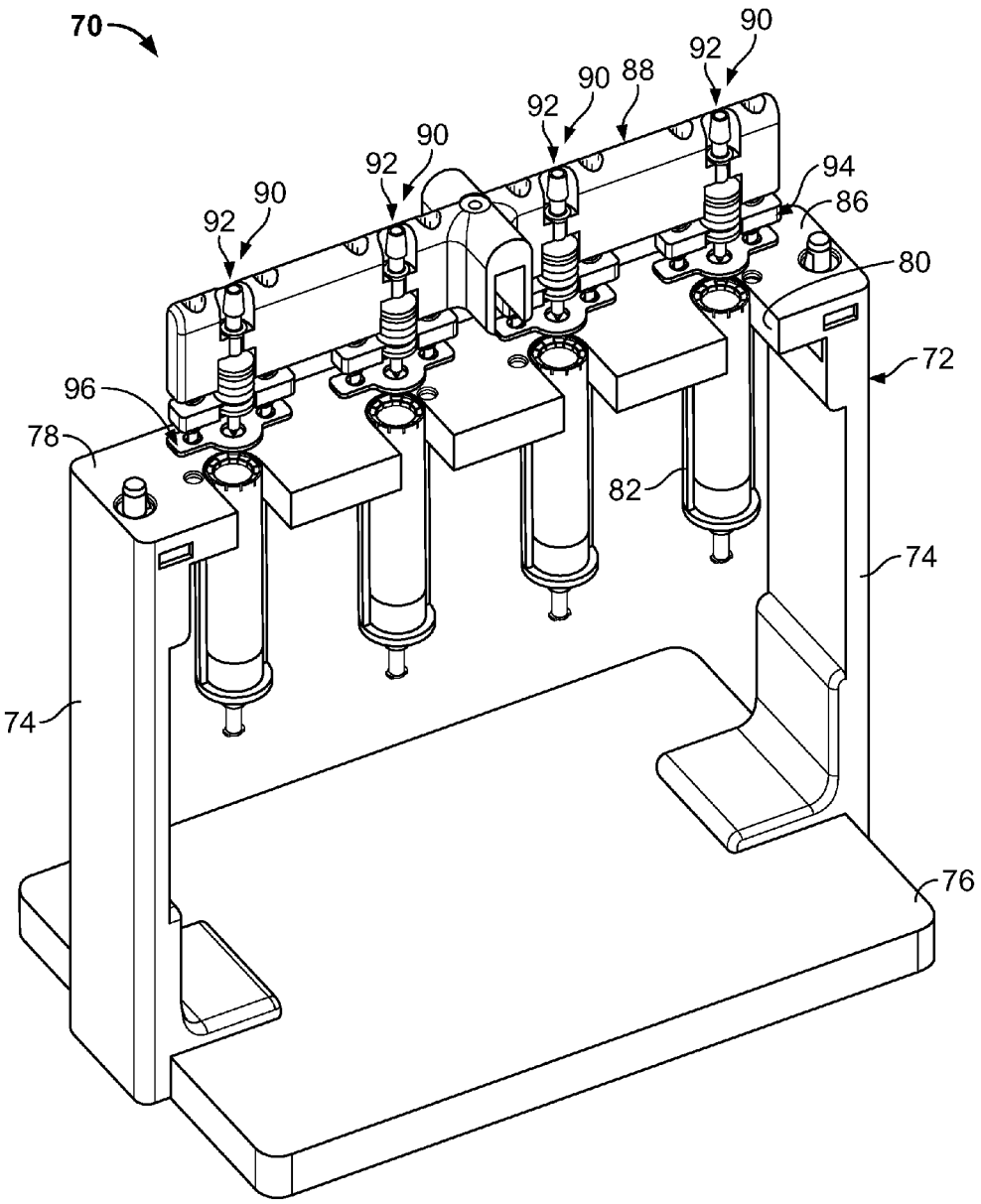
FIG. 10 is a perspective top view of a filling apparatus for filling the device of FIG. 1.
Figure 11:
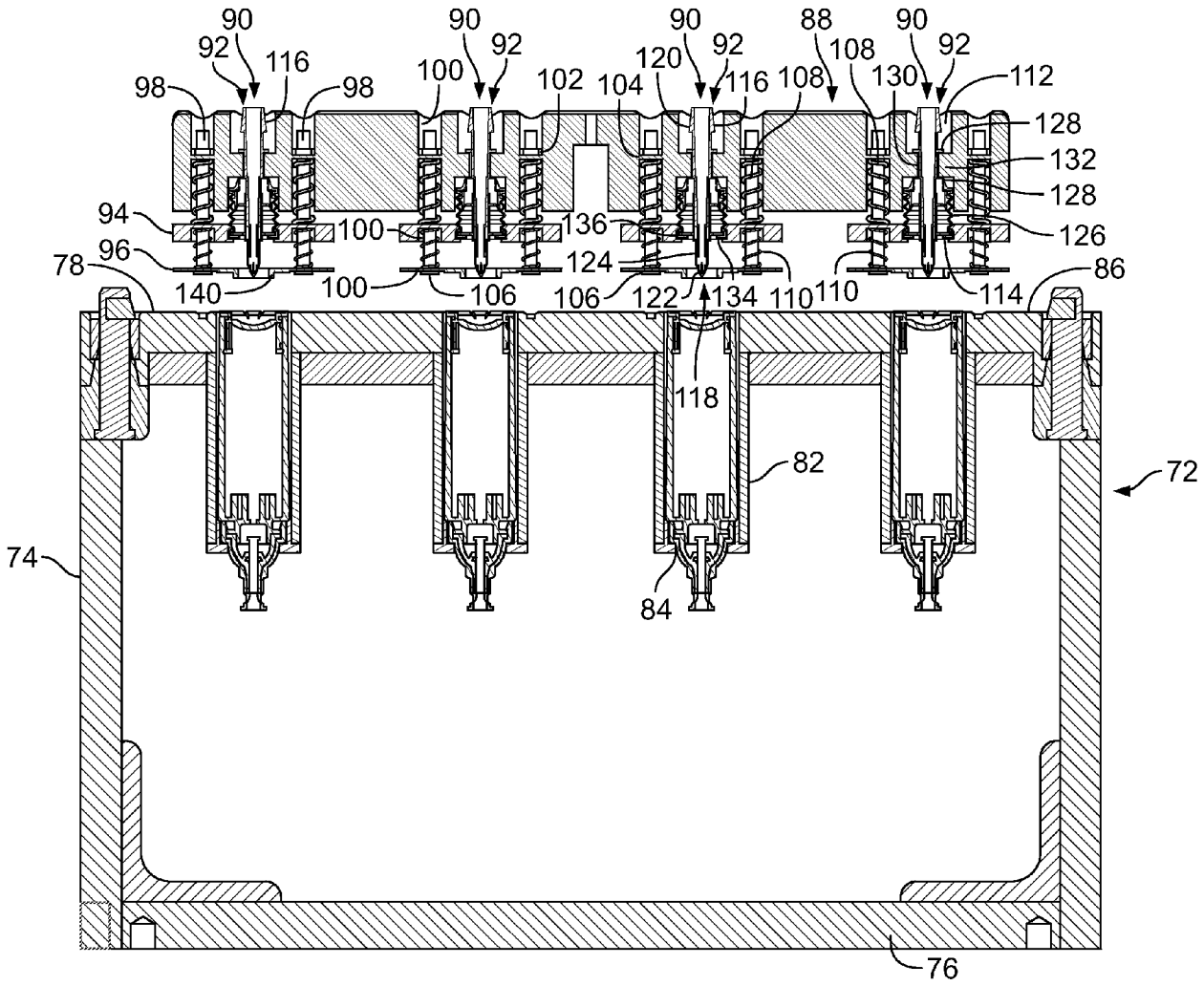
FIG. 11 is a cross-sectional side view of the filling apparatus of FIG. 10 in the initial disengaged position.

As shown in FIGS. 7-9, the valve 214 defines a longer valve seat 236 and valve member 238, relative to the valve seat 36 and valve member 38, to extend through the neck 229 of the connector 224 and to valve opening 234. The valve member 238 defines two laterally-extending annular seals 239 that extend about the valve member 238 and form a sliding, fluid-tight seal between the valve member 238 and the interior surface of the neck 229. The annular seals 239 can be dimensioned to form an interference fit with the substantially cylindrical interior surface of the neck 229 and thereby form the fluid-tight seal therebetween. The seals 239 are positioned along the valve member 238 such that they engage the interior surfaces of the neck 229 both when the valve 214 is in the first position and in the second position. Thus, in the second position, the cavity 241 between the valve 214 and the connector 224 is sealed from liquid entry. This helps ensure that dispensed fluid actually flows into the delivery device or syringe (as opposed to flowing into the cavity 241), and helps prevent contamination of fluid transferred into the delivery device. Further, fluid in the cavity 241 can impede movement of the valve due to the compression force of fluid in the cavity 241. As should be understood by those of ordinary skill in the pertinent art, the valve member 238 may alternatively define a single seal 239 or more than two seals 239.

As shown, the outlet end 238*a* of the valve member 238 defines a substantially tapered cross-section. The interior surface 244 of the connector tip 228 defines a corresponding tapered cross-section to engage the outlet end 238*a* of the valve member 238 when the valve 214 is in the first position. Similar to the device shown in FIGS. 1-5, in the first position the valve member 238 cannot expand or move from the valve seat 236, and the valve is locked in a closed position. The groove 237 extends through the valve seat 236 from the base end thereof (adjacent the storage chamber 218) to the tapered outlet end 238*a* of the valve member 238. As fluid can pass between the valve member 238 and the valve seat 236 through the groove 237, only the tapered outlet end 238*a* of the valve member 238 need be expanded relative to the valve seat 236 for the flow of substance completely through the valve 224.

Similar to the embodiment of FIGS. 1-5 above, engagement of the delivery device 25 with the connector 224, as show in FIG. 9, moves the valve 224 from the first position into the second position. In the illustrated embodiment, as shown in FIGS. 7 and 8, the LUER connector tip 228, includes an annular guide 231, extending about the connector tip 228, for guiding the delivery device 25 in connection with the connector tip 228.

Upon engagement of the valve 214 with the delivery device 25, thereby moving the valve 214 from the first position into the second position (FIG. 9), the tapered portion 238*a* of the valve member 238 is depressed into the larger cylindrical neck 229. As the neck 229 defines a larger interior space, the tapered portion 238*a* of the valve member 238 is not engaged with the interior surface thereof. Thus, the tapered portion 238*a* can expand relative to the valve seat 236 when a pressure differential cross the valve 214 exceeds the valve opening pressure. When the delivery device 25 induces a pressure across the valve 214, e.g., by withdrawal of a plunger of a syringe, that is greater than the valve opening pressure, the tapered portion 238*a* expands away from the valve seat 236, to, in turn, open the valve 214. Substance can then be withdrawn from the storage chamber 218 and dispensed out of the device 10 through the valve 214.

In some embodiments, the devices 10, 210 are mounted into a filling apparatus, for automated filling thereof. An exemplary filling apparatus is disclosed in U.S. Provisional Patent Application No. 61/686,867, filed Apr. 13, 2012, entitled, Modular Filling Apparatus and Method," which is hereby expressly incorporated by reference in its entirety as part of the present disclosure as if fully set forth herein.

In some embodiments, a filling apparatus 70, as shown in FIGS. 10-14, is utilized to fill the device(s) 10, 210. The filling apparatus 70 includes a frame 72, having first and second axially-elongated supports 74 laterally spaced apart, a base frame member 76 extending therebetween at a lower end thereof, and an upper frame member 78 extending therebetween at an upper end thereof. The upper frame member 78 defines a series of laterally-spaced slots 80 each having an axially-extending device support member 82 extending therefrom toward the base frame member 76. The device support members 82 are configured to fittingly and securely receive therein respective devices 10, 210 for filling. Each support member 82 defines an aperture 84 at the end opposing the upper frame member 78, sized to receive the connector 24, 224 of the device 10, 210 therethrough, and engage the shoulder 32, 232 thereof. When mounted in a device support member 82, the base end of a device 10, 210 is substantially flush with an upper surface 86 of the upper frame member 78. In the illustrated embodiment, the flexible portion 53, 253, (e.g., the laterally-extending petals 54, 254) of the sliding stopper 16, 216, engaging the annular rim 58, 258 at the base end of the device body 12, 212 are substantially flush with the upper surface 86.

As shown in FIGS. 10-14, a filling device support 88 is positioned above, and movable into and out of engagement with, the upper frame member 78. The filling device support 88 includes a series of laterally-spaced modules 90 having a series of respective filling devices 92 mounted therein. Each module 90 is operatively attached to first and second plates 94, 96 positioned between the filling device support 88 and the upper frame member 78. A respective first plate 94 is axially spaced from a respective module 90, and a respective second plate 96 is axially spaced from the first plate 94. In the illustrated embodiment, each module 90, first plate 94, and second plate 96 are operatively connected to one another via a pair of axially-extending poles 98 located on opposite sides of the filling device 92. The poles 98 extend through, and are slidably moveable within, respective axially-elongated and aligned channels 100 in each of the module 90, first plate 94, and second plate 96. Adjacent the upper end of each pole 98 is also a laterally-extending upper annular projection 102. Each module channel 90 includes a corresponding annular lip 104, laterally extending from the sidewall thereof, for engaging the annular projection 102, and thus supporting the axial pole 98. The lower end of the each pole 98 includes a laterally-extending lower annular projection 106. The lower annular projection engages the bottom surface of the second plate channel 96, for supporting the second plate 96 thereon. Each pole 98 is encased with two springs 108, 110, positioned in series and substantially axially aligned. The first spring 108 extends between the upper annular projection 104 and first plate 94. The second spring 110 extends between the first plate 94 and the second plate 96. As the poles 98 are slideable within the channels 100, each respective module 90, first plate 94, and second plate 96, are movable with respect to one another. The pair of first springs 108 naturally bias the module 90 and the first plate 94, in an axially-spaced position relative to one another. Similarly, the pair of second springs 110 also bias the first plate 94 and the second plate 96 into an axially-spaced position relative to one another. However, the module 90, first plate 94, and second plate 96 are movable, against the bias of the first and second spring pairs 108, 110, into axially-abutting positions relative to one another, as described further below. The first springs 108 defines a spring constant that is greater than the spring constant of the second springs 110. Thus, an axial force applied to the first and second spring pairs 108, 110, will substantially compress the second spring pair 108, more than or prior to compressing the first spring pair 110. Accordingly, an axial force applied to the module 90, first plate 94, and second plate 96, will substantially move the first plate 94 from the normal axially-spaced position, into an axially-abutting position with the second plate 96, prior to substantially moving the module 90 from the normal axially-spaced position, into an axially-abutting position with the first plate 94. The module 90 will move appreciably toward the axially-abutting position with the first plate 94 after the first plate 94 is axially-abutting the second plate 96. As should be understood by those of ordinary skill in the pertinent art, a single spring defining two different spring rates may equally be utilized instead of the first and second springs positioned in series.

Each filling device 92 is securely mounted to a module 90 and a first plate 94. As should be understood by those of ordinary skill in the pertinent art, the filling device may be securely mounted to the module and first plate in any of numerous different manners, such that the filling device is capable of performing the functions described further herein. In the illustrated embodiment, each module 90 and first plate 94 define axially-extending and aligned filling device channels 112, 114, each receiving and supporting a portion of the filling device 92 therein. Exemplary filling devices are disclosed in U.S. patent application Ser. No. 13/450,306, filed Apr. 18, 2012, entitled "Needle with Closure and Method," which, in turn, claims priority to U.S. Provisional Patent Application Ser. No. 61/476,523, filed Apr. 18, 2011, entitled "Filling Needle and Method;" and U.S. Provisional Patent Application No. 61/659,382, filed Jun. 13, 2012, entitled "Device with Penetrable Septum, Filling Needle and Penetrable Closure, and Related Method," each of which is hereby expressly incorporated by reference in its entirety as part of the present disclosure as if fully set forth herein.

In some embodiments, the filling device 92 comprises a hollow elongated filling member 116, having a tip 118 formed at a distal end thereof and a filling line attachment fitting 120 at a proximal end thereof. The filling member 116 includes at least one port 122, in fluid communication with the interior thereof, positioned proximally adjacent to the tip 118. A relatively rigid closure 124, e.g., an annular shutter, sealingly closes the port(s) 122. A relatively flexible annular shell 126, defining an integral spring, sealingly encloses, and is operatively connected to, the closure 124, as described further below. In the illustrated embodiment, the flexible shell 126 is a bellows. However, as may be recognized by those of ordinary skill in the pertinent art based on the teachings herein, the flexible shell may take any of numerous different configurations that are currently known, or that later become known, for performing the function of the shell as described herein.

The filling member 116 further includes axially-spaced annular shoulders 128 laterally extending therefrom, defining a neck portion 130 therebetween, proximally adjacent to the flexible shell 126. Each module filling device channel 112 includes a corresponding lateral projection 132, inwardly extending from the sidewall thereof. The projection 132 is fittingly received within the neck 130 of the filling member 116, between the annular shoulders 128, for secure mounting of the filling device 92 to the module 90. The filling device 92 is securely mounted to the first plate 94 via a laterally-extending annular projection 134 of the flexible shell 126, engaging a corresponding laterally-extending annular channel 136 in the sidewall of the first plate filling device channel 114.

In the illustrated embodiment, the closure 124 and/or the filling member 116 of the filling device 92 is slideable between (i) a first position wherein the closure 124 closes the port(s) 122, and (ii) a second position opening the port(s) 122. In the closed position, the closure 124 forms a substantially fluid-tight seal between the port(s) 122 and ambient atmosphere. The first spring pair 108, aided by the integral spring of the flexible annular shell 126, normally bias the closure 124 in the direction from the second or open position toward the first or closed position to normally close the port(s) 122.

In the illustrated embodiment, the filling device tip 118 is defined by a non-coring, conically-pointed tip; however, as may be recognized by those of ordinary skill in the pertinent art based on the teachings herein, the filling device tip may define any of numerous other tip configurations that are currently known, or that later become known, such as a trocar tip. In one configuration, the spring force of the first spring pair 108 and the flexible shell 126 is sufficient to allow the filling device 90 to penetrate a septum of an opposing device, such as the septum 48, while maintaining the closure 124 in the closed position during penetration of the tip 118 and closure 124 through the septum and until the first plate 94 engages the second plate 96, as described further below. That is, the forces keeping the closure 124 in the sealing position are less than the countervailing forces applied to the closure 124 during penetration of the septum. Afterwards, the engagement of the first and second plates 94, 96, only permits relative movement of the closure 124 and filling member 116, against the bias of the first spring pair 108, from the normally closed position to the open position and, in turn, expose the sterile filling device port(s) 122 within the sterile device chamber, such as for example, the storage chamber 48.

In the illustrated embodiment, the filling line attachment fitting 120 is a barbed fitting for attachment to a filling line (not shown). As may be recognized by those of ordinary skill in the pertinent art, any of numerous different types of fittings, connections or connectors that are currently known, or that later become known, equally may be employed for connecting the filling device to a filling or other type of line or conduit. For example, the proximal end of the filling device may define a male or a female connector for aseptically or sterile connecting to the other of the male or female connector attached to a filling line, as disclosed in U.S. Provisional Patent Application Ser. No. 61/641,248, filed May 1, 2012, entitled "Device for Connecting or Filling and Method;" U.S. Provisional Patent Application Ser. No. 61/635,258, filed Apr. 18, 2012, entitled "Self-Closing Connector;" and similarly titled U.S. Provisional Patent Application Ser. No. 61/625,663, filed Apr. 17, 2012, each of which is hereby expressly incorporated by reference in its entirety as part of the present disclosure as if fully set forth herein.

Figure 12:
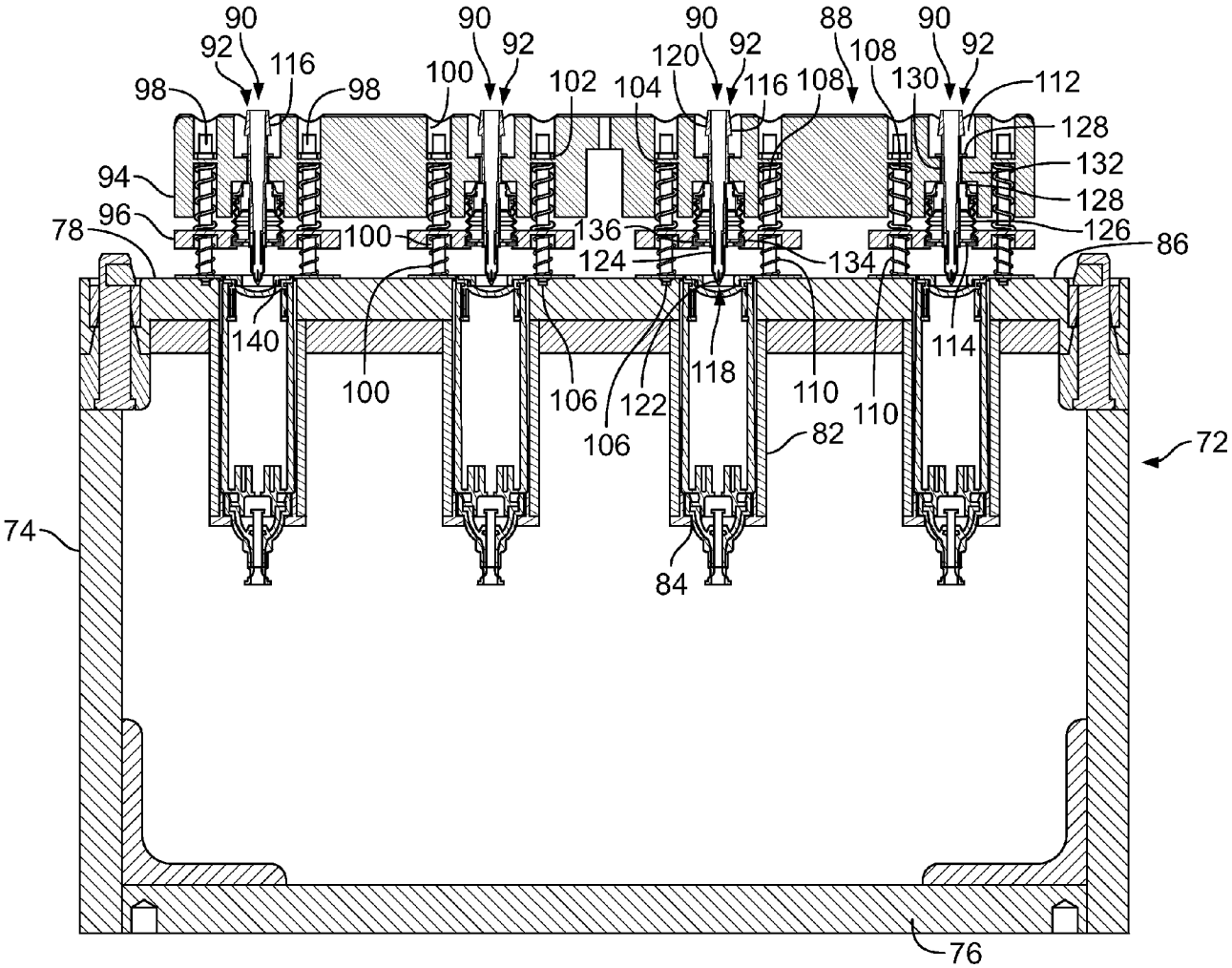
FIG. 12 is a cross-sectional side view of the filling apparatus of FIG. 10 in the first engaged position.

The filling apparatus 70 may be utilized to aseptically or sterile fill fluids through the penetrable septum 48, 248 and into the chamber 18, 218 of the devices 10, 210. To do so, a device 10, 210 is first mounted into a device support member 82. When mounted, the laterally-extending petals 54, 254 or other flexible portion 53, 253 of the stopper 16, 216 are positioned substantially flush with the upper surface 86 of the upper frame 78. The filling device support 88 is then moved toward the device 10, 210 from an initial disengaged position (FIG. 11), where the module 90, first plate 94, and second plate 96, are all axially spaced from one another and from the upper frame member 78, to a first engaged position, such that the second plate 96 engages the upper frame member 78 (FIG. 12). In the first engaged position, the second plate 96 engages the upper surface 86 of the upper frame member 78, and the substantially flush flexible portion 53, 253 or laterally-extending petals 54, 254 of the stopper 16, 216. The petals 54, 254 are thus fixed or clamped in place between the upper frame member 78 and the second plate 96, i.e., fixed in engagement with the device body base annular rim 58, 258, thereby fixedly securing the axial position of the stopper 16, 216 at the base opening 22, 222 of the device body. The second plate 96 also defines an approximately central axially-extending annular projection 140 that engages a portion of the sidewall of the substantially cylindrical rigid body 46, 246 of the sliding stopper 16, 216 proximal to the septum 48, 248. In the first engaged position, the tip 118 of the filling device 92 is positioned adjacent the septum 48, 248. Prior to penetrating the septum 48, 248 and when the filling device tip 118 is exposed to the ambient atmosphere, the closure 124 remains in the closed position, sealing the port(s) 122 with respect to ambient atmosphere to thereby maintain the sterility of the ports and of the interior of the filling device.

Figure 13:
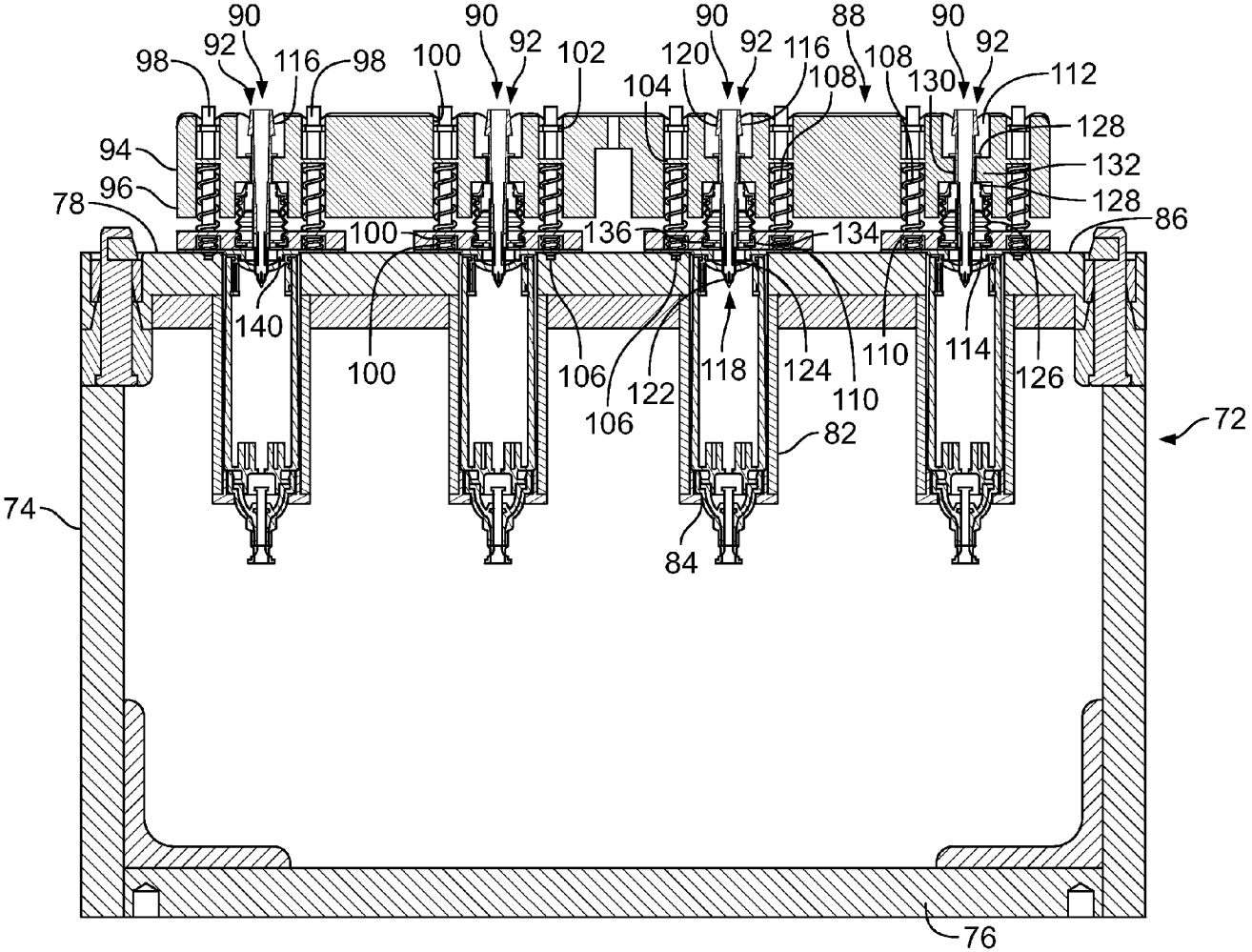
FIG. 13 is a cross-sectional side view of the filling apparatus of FIG. 10 in the second engaged position.

Thereafter, the filling device support 88 is further depressed from the first engaged position to a second engaged position (FIG. 13). Since the second plate 96 is already engaged with the upper frame member 78, the movement of the filling device support 88 from the first to the second engaged position applies an axial force onto the first and second spring pairs 108, 110. As the second spring pair 110 defines a lower spring rate than the first spring pair 108, the movement of the filling device support 88 from the first to the second engaged position compresses the second spring pair 110 and, in turn, engages the first plate 94 with the second plate 96. As the first plate 94 moves toward the second plate 96, the filling device tip 118 engages and penetrates through the septum 48, 248 and enters into the storage chamber 18, 218 of the device 10, 210. The first spring pair 108 remains relatively uncompressed during this movement, and accordingly, the module 90 remains in a substantially axially-spaced position relative to the first plate 94. The closure 124 also remains in the first closed position, sealing the port(s) 122. Thus, the closure 124 remains interposed between the port(s) 122 and the septum 48, 248 to substantially prevent contact between the ports and the septum. However, once the first plate 94 is engaged with the second plate 96, the axial position of the closure 124 is fixed, i.e., the closure is prevented from further penetration into the storage chamber 18, 218. As the module 90 remains substantially axially spaced from the first plate 94, the axial position of the filling member 116 is not fixed, i.e. the filling member may further penetrate into the storage chamber 18, 218.

Figure 14:
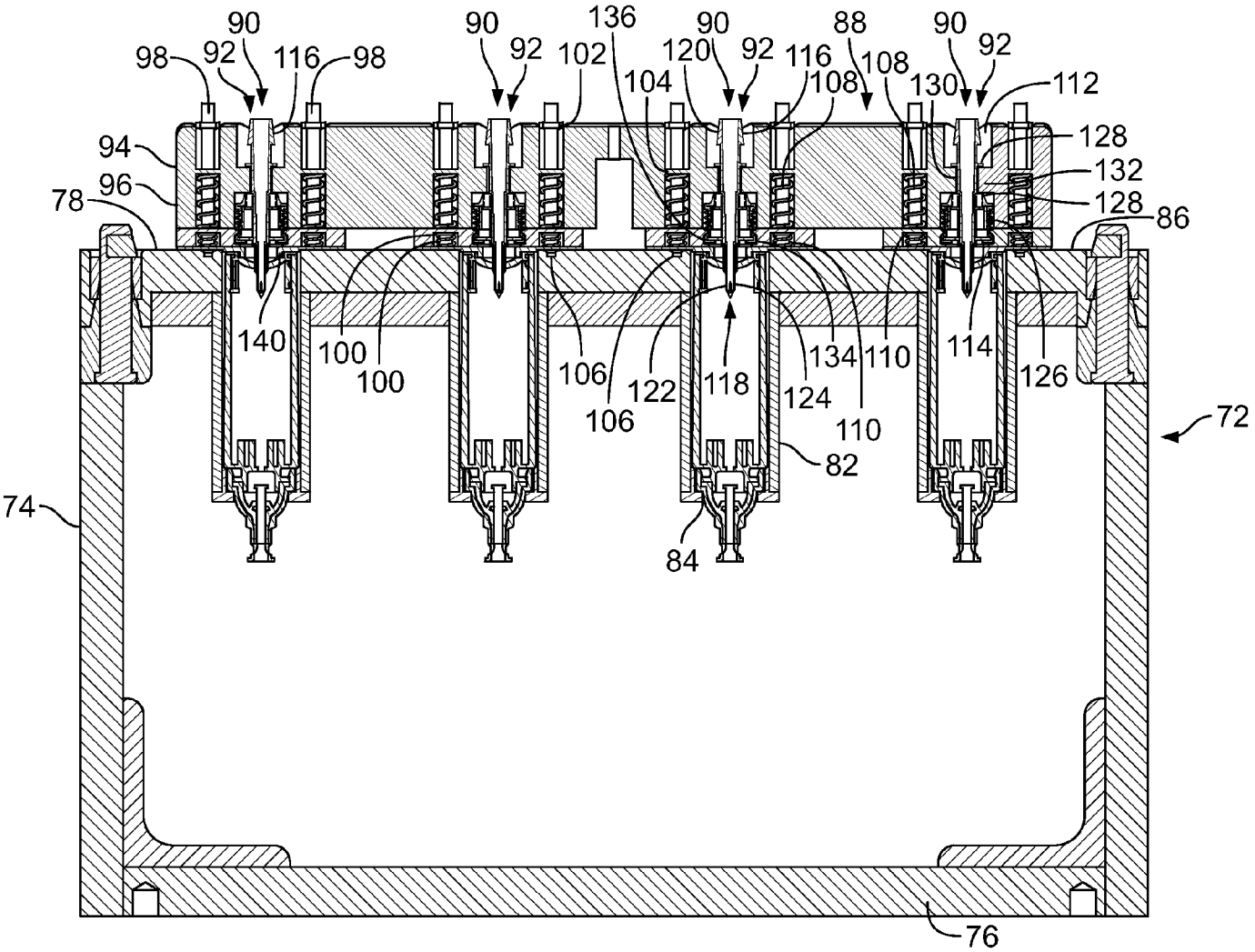
FIG. 14 is a cross-sectional side view of the filling apparatus of FIG. 10 in the third engaged position.

Thereafter, the filling device support 88 is further depressed from the second engaged position to a third and fully engaged position (FIG. 14). Since the first plate 94 is already engaged with the second plate 96, i.e., the second spring pair 110 are already compressed, the movement of the filling device support 88 from the second to the third engaged positions compresses the first spring pair 108 and, in turn, engages the module 90 with the first plate 94. Movement of the filling device support 88 from the second to the third engaged positions, results in further penetration of the filling member 116 into the chamber 18, 218 of the device 10, 210, while the axial position of the closure 124 remains fixed. As the closure 124 is prevented from further axial penetration, the filling member 116 and filling device tip 118 slide relative to the closure 124, to, in turn, move the port(s) 122 to the open position (FIG. 14), beyond the closure 124, within the chamber 18, 218. In the open position, the substance within the filling device 92 is permitted to flow through the open port(s) 122 and into the chamber 18, 218. Since the sterile port(s) 122 are never exposed to the ambient atmosphere throughout the filling process, the port(s), interior of the filling device, and fluid flowing therethrough, are not contaminated and/or are maintained aseptic or sterile as the fluid is injected or otherwise filled into the chamber 18, 218.

In some embodiments, the septum 48, 248 wipes the tip 118 of the filling member 116 and closure 124 clean of contaminants thereon during engagement and penetration of the septum by the tip, in accordance with the teachings of U.S. Provisional Patent Application No. 61/659,382, entitled "Device with Penetrable Septum, Filling Needle and Penetrable Closure, and Related Method," which is previously incorporated by reference above. Such wiping, in turn, prevents the tip and/or shutter closure from introducing such contaminants into the sterile interior of the chamber 18, 218 and thereby maintains the chamber and any substance therein aseptic or sterile.

After the chamber 18, 218 is filled as desired, the filling device 92 is withdrawn therefrom and from the septum 48, 248. The filling device support 88 is moved away from the upper frame member 78, from the third engaged position to the second engaged position. Because the first spring pair 108 defines a greater spring rate than the second spring pair 110, the first spring pair rebounds into an uncompressed state and substantially maintains the second spring pair 110 in the compressed state in the process. Thus, the module 90 disengages from the first plate 94 and moves back into an axially-spaced position relative thereto, while substantially maintaining the first plate 94 in engagement with the second plate 96. As the first spring pair 108 rebounds, the springs bias the closure 124 downwardly or in the direction of the septum 48, 248. Therefore, as the filling member 116 is withdrawn, it is moved axially relative to the closure 124 to, in turn, move the port(s) 122 back into the closed position behind the closure. The closure 124 substantially prevents contact between the filling device port(s) 122 and the septum 48, 248 during withdrawal therefrom.

Thereafter, the filling device support 88 is moved back into the first engaged position from the second engaged, to, in turn, disengage the first and second plates 94, 96 and return the them to the axially-spaced position relative to one another. The filling member 116 is also withdrawn from the septum 48, 248. The closure 124 is maintained in the closed position by the downward force or bias of the first spring pair 108. Afterwards, the filling device support 88 is returned to the disengaged position from the first engaged position, to, in turn, disengage the second plate 96 from the upper surface 86 of the upper frame member 78 and from the laterally-extending petals 54, 254 of the stopper 16, 216.

As previously explained, the septum 48, 248 is engineered to self-close and thereby ensure that the head loss left by the residual piercing aperture after the filling device 92 is withdrawn to prevent any fluid ingress therethrough. Nonetheless, although the septum is self-closing, the resulting piercing aperture in the septum 48, 248 may be resealed mechanically (such as by an overlying cover (not shown)), by applying a liquid sealant thereto, such as a silicone or silicon-based sealant, and/or by applying radiation or energy thereto, e.g., laser radiation or energy, in accordance with the teachings of the patents and application incorporated by reference above. Such resealing forms a fluid tight or hermetic seal and thereby maintains the sterility of the filled substance.

After resealing of the septum 48, 248, the stopper 16, 216 is depressed into the body to, in turn, bend the flexible portion 53, 253, e.g., petals 54, 254 inwardly about the living hinge(s) 56, 256 thereof into the axially-extending position. The axial position of the stopper 16, 216 is thereafter no longer fixed with respect to the device body 12, 212 but rather can move axially therethrough. The cap 60, 260 is then inserted into the opening 22, 222 in the base end of the device body 12, 212, as explained above. Thereafter, when a delivery device 25 is connected to the valve 14, 214 and withdraws a dose of the substance within the chamber 18, 218 via a suction force, it creates a partial vacuum in the storage chamber 18, 218, and the resulting the suction force exerted on the sliding stopper 16, 216 causes the stopper to move axially within the device body 12, 212 toward the valve 14, 214 to reduce the volume of the variable-volume storage chamber 18, 218 by substantially the same volume of each dose dispensed and equalize the pressure.

In some embodiments, the devices 10, 210 may alternatively be manually filled by a free-standing filling device 392. The device 392 is not part of a filling apparatus, and therefore the devices 10, 210 need not be placed in a filling apparatus. Filling of the devices 10, 210 is achieved via the filling device 392 in substantially the same manner as disclosed above with respect to the filling device 92. Therefore, like reference numerals preceded by the numeral "3" are used to indicate like elements.

Figure 15A:
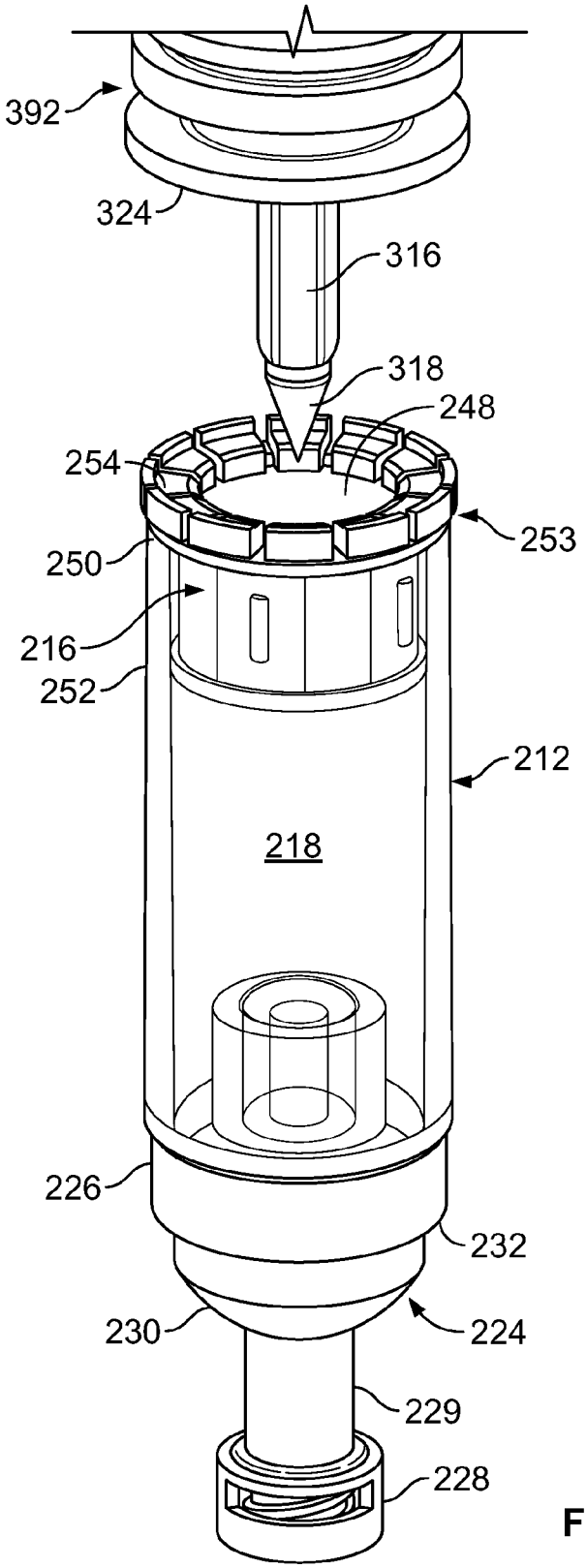
FIGS. 15A-E are sequential cross-sectional views of the device of FIG. 6, showing the sliding stopper before penetration of the resealable septum thereof by a filling device, during penetration thereof and after withdrawal of the filling device therefrom.
Figure 15B:
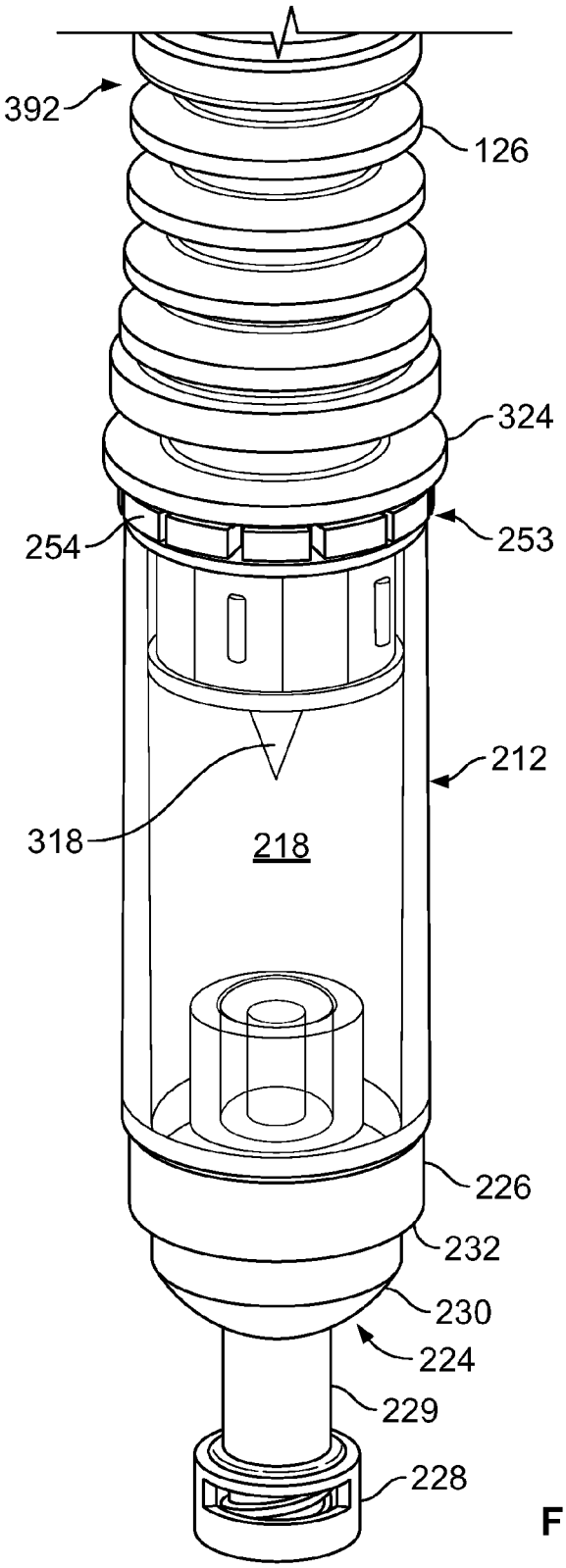
Figure 15C:
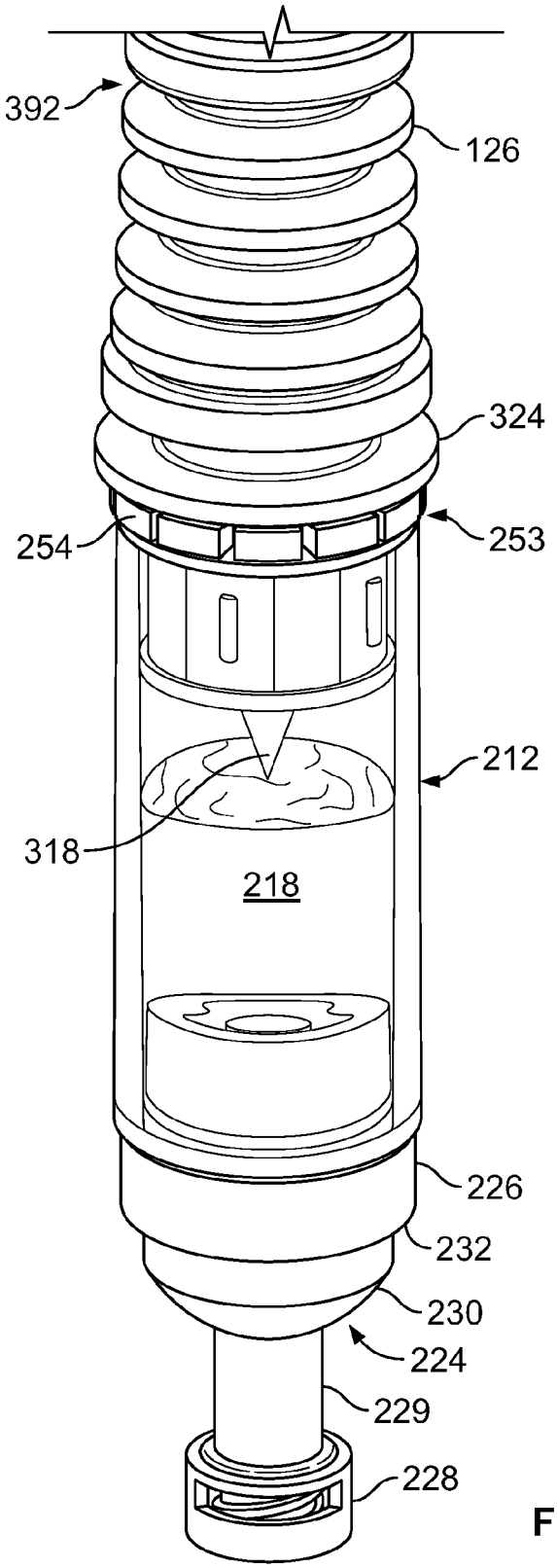

A primary difference between the filling device 92 and the filling device 392 is that the annular closure 324 of the filling device 392 is dimensioned, as shown in FIG. 15A, such that the closure 324 itself engages the flexible portion 53, 253, e.g., laterally-extending petals 54, 254, of the stopper 16, 216 during filling. Thus, as shown in FIG. 15B, the closure 324 itself fixes the petals 54, 254 in place, i.e., in engagement with the annular rim 58, 258 of the device body 12, 212, to, in turn fix the axial position of the stopper 16, 216. Upon penetration of the filling device tip 318 through the septum 48, 248, engagement of the closure 324 with the petals 54, 254 also prevents further axial movement of the closure 324 relative to the filling member 316. Further advancement of the filling device 392 further advances the filling member 316 into the storage chamber 18, 218, relative to the closure 324, thereby opening the port(s) (not shown) and allowing substance to flow through the open port(s) and into the chamber 18, 218 (FIG. 15C).

Figure 15D:
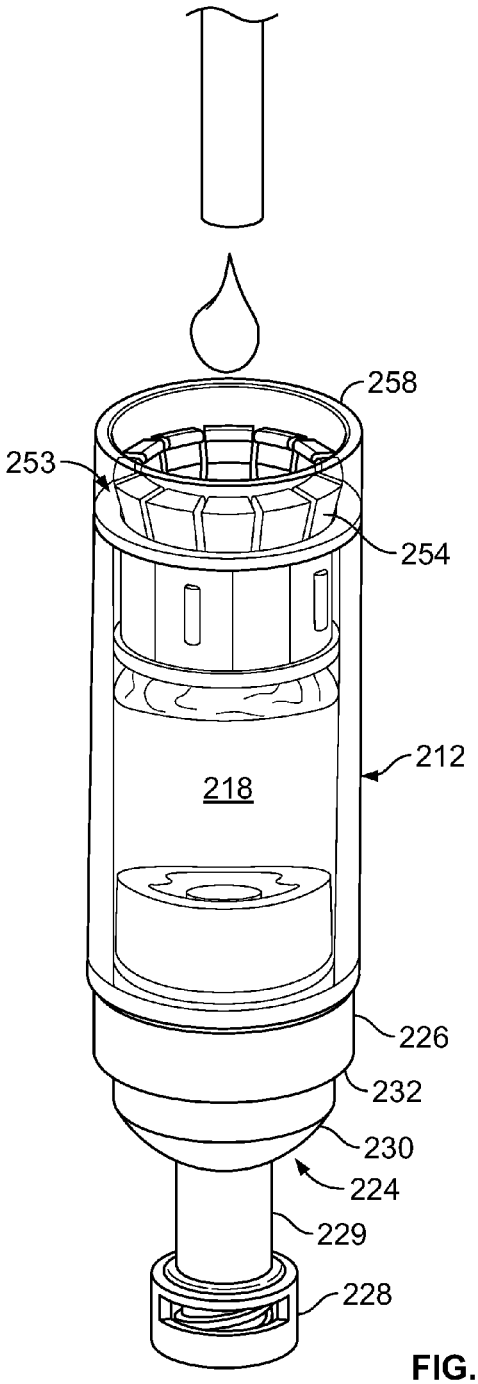
Figure 15E:
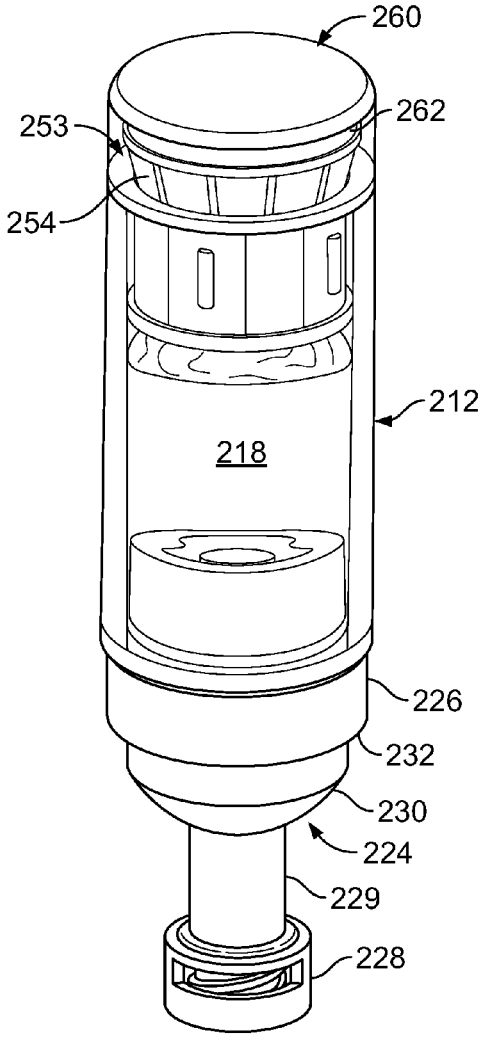

After the storage chamber 18, 218 is filled as desired, the filling device 392 is withdrawn from the chamber 18, 218, and the closure 324 reseals the port(s) in similar manner as described above with respect to the embodiment of FIGS. 10-14. As shown in FIG. 15D, the stopper 16, 216 is depressed into the chamber 18, 218, to, in turn, bend the petals 54, 254 inwardly about the living hinges 56, 256 thereof so that the flexible portion 53, 253 is in the axially-extending position. The axial position of the stopper 16, 216 is thereafter no longer fixed with respect to the device body 12, 212 but rather can move axially therethrough. Similar to the embodiments described above, the septum 48, 248 of the stopper 16, 216 can be resealed. The cap 60, 260 can then be mounted onto the body 12, 212 to close the opening 22, 222 thereof (FIG. 15E).

As may be recognized by those of ordinary skill in the pertinent art based on the teachings herein, numerous changes and modifications may be made to the above-described and other embodiments of the present invention without departing from the scope of the invention. For example, the components of the device may be made of any of numerous different materials or combinations of materials that are currently known, or that later become known for performing the function(s) of each such component. Similarly, the components of the device may take any of numerous different shapes and/or configurations, and may be manufactured in accordance with any of numerous different methods or techniques that are currently known, or later become known.

As another example, the sliding stopper may be utilized with any of numerous different rigid devices defining storage chambers therein. Exemplary such devices, without limitation, are disclosed in U.S. patent application Ser. No. 13/743,661, filed Jan. 17, 2013, entitled "Multiple Dose Syringe," which, in turn, claims priority from similarly titled U.S. Provisional Patent Application Ser. No. 61/587,500, filed Jan. 17, 2012; and U.S. patent application Ser. No. 13/745,721, filed Jan. 18, 2013, entitled "Device with Co-Molded Closure, One-Way Valve, Variable-Volume Storage Chamber, and Anti-Spritz Feature and Related Method," which, in turn, claims priority from similarly titled U.S. Provisional Patent Application Ser. No. 61/589,266, filed Jan. 20, 2012.

The vial or other device embodying the present invention also may be used to store and dispense any of numerous different types of fluids or other substances for any of numerous different applications that are currently known, or later become known. Accordingly, this detailed description of currently preferred embodiments is to be taken in an illustrative, as opposed to a limiting sense.

What is claimed is:

1. A filling apparatus comprising:

a frame having axially spaced upper and lower laterally-extending frame members attached via first and second axially-elongated, laterally spaced supports, wherein the upper frame member defines at least one slot and device support member extending therefrom toward the lower frame member dimensioned to receive a device to be filled therein such that an end of the device is substantially flush with the upper frame member, a filling device support positioned above the frame and including at least one module, at least one respective first plate, and at least one respective second plate, axially aligned with one another, and a filling device mounted between each of the at least one module and first plate, wherein the module, first plate and second plate are movable with respect to one another and with respect to the frame between (i) an initially disengaged position, wherein the first plate is axially spaced from the module, the second plate is axially spaced from the first plate, and the upper frame member is axially spaced from the second plate, (ii) a first engaged position, wherein the first plate is axially spaced from the module, the second plate is axially spaced from the first plate, and the second plate is engaged with the upper frame member, (iii) a second engaged position, wherein the first plate is axially spaced from the module, the first plate is engaged with the second plate, and the second plate is engaged with the upper frame member, and (iv) a third and fully engaged position, wherein the module is engaged with the first plate, the first plate is engaged with the second plate, and the second plate is engaged with the upper frame member.

2. A filling apparatus as defined in claim 1, wherein the filling device comprises a hollow filling member, a tip formed at one end of the filling member, at least one port in fluid communication with the interior of the hollow filling member, and a closure, wherein at least one of the closure and filling member is movable between (i) a first position wherein the closure closes the at least one port and forms a fluid-tight seal between the at least one port and ambient atmosphere to maintain sterility of the at least one port and an interior of the filling member, and (ii) a second position opening the at least one port.

3. A filling apparatus as defined in claim 2, wherein the closure and/or filling member is in the first position when the module, first plate and second plate are in the disengaged position, the first engaged position or the second engaged position.

4. A filling apparatus as defined in claim 2, wherein the closure and/or filling member is in the second position when the module, first plate and second plate are in the third and fully engaged position.

5. A filling apparatus as defined in claim 2, wherein the second plate engages the end of the device in the first, second and third engaged positions.

* * * * *